US006762546B1

(12) United States Patent
Kurokawa et al.

(10) Patent No.: US 6,762,546 B1
(45) Date of Patent: Jul. 13, 2004

(54) CATHODE RAY TUBE AND IMAGE DISPLAY APPARATUS USING THE SAME

(75) Inventors: Hideo Kurokawa, Katano (JP); Koji Akiyama, Neyagawa (JP); Michiaki Watanabe, Ibaraki (JP); Toshifumi Nakatani, Moriguchi (JP); Hideo Suzuki, Hirakata (JP); Shigeru Ohki, Habikino (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 10/070,551

(22) PCT Filed: Oct. 23, 2000

(86) PCT No.: PCT/JP00/07392

§ 371 (c)(1),
(2), (4) Date: Mar. 7, 2002

(87) PCT Pub. No.: WO01/29865

PCT Pub. Date: Apr. 26, 2001

(30) Foreign Application Priority Data

Oct. 21, 1999 (JP) ..... 11/299654
Dec. 24, 1999 (JP) ..... 11/367205

(51) Int. Cl.[7] ..... H01J 29/07; H01J 29/81
(52) U.S. Cl. ..... 313/404; 313/407
(58) Field of Search ..... 313/407, 404, 313/269, 402, 405, 406

(56) References Cited

U.S. PATENT DOCUMENTS 4,827,180 A 5/1989 Sone et al. ..... 313/404
4,963,786 A * 10/1990 Tokita et al. ..... 313/406
5,210,459 A * 5/1993 Lee ..... 313/406
5,274,301 A * 12/1993 Takahashi et al. ..... 313/406
5,663,610 A * 9/1997 Inoue et al. ..... 313/461
5,780,962 A 7/1998 Fujii et al. ..... 313/402
5,990,607 A * 11/1999 Tseng et al. ..... 313/407
6,037,709 A * 3/2000 Nakagawa et al. ..... 313/404
6,342,760 B1 * 1/2002 Mashimo et al. ..... 313/477 R
6,469,430 B1 10/2002 Saita et al. ..... 313/404
6,469,431 B1 * 10/2002 Suzuki et al. ..... 313/407

FOREIGN PATENT DOCUMENTS

| | | |
|---|---|---|
| JP | 45-21802 | 8/1970 |
| JP | 56-012770 | 2/1981 |
| JP | 58-179740 | 12/1983 |
| JP | 04-092334 | 3/1992 |
| JP | 8-24032 | 3/1996 |
| JP | 2565899 | 10/1996 |
| JP | 9-35653 | 2/1997 |
| JP | 09-045256 | 2/1997 |
| JP | 9-153333 | 6/1997 |
| JP | 09-293459 | 11/1997 |
| JP | 11-054061 | 2/1999 |
| JP | 11-288672 | 10/1999 |

* cited by examiner

*Primary Examiner*—Wilson Lee
*Assistant Examiner*—Chuc Tran
(74) *Attorney, Agent, or Firm*—Parkhurst & Wendel, L.L.P.

(57) ABSTRACT

An elastic support member 5 or an elastic support member-holding plate is located substantially in the middle portion of a frame portion (1 and 2), and a shadow mask is constructed such that a tension in the middle portion of the shadow mask 3 is larger than the tension in the edge portions of the shadow mask 3. In another aspect, a plurality of elastic support members 5 are such that at least two elastic support members having substantially different spring constants are combined.

23 Claims, 21 Drawing Sheets

A vibration suppressing time means a time required for attenuating the amplitude of vibration to not more than 1/10

Condition of frame vibration when all of the spring constants are identical (k=1.2 kgf/mm)

Condition of frame vibration when a combination of spring constants of k =1.2kgf/mm and k=0.2kgf/mm is employed

CATHODE RAY TUBE AND IMAGE DISPLAY APPARATUS USING THE SAME

TECHNICAL FIELD

The present invention relates to a cathode ray tube (hereinbelow, called a color picture tube in the specification) and an image display apparatus using the same. More particularly, the invention relates to a color picture tube which is characterized by an elastic support member used to support a frame across which a mask is stretched in a state where a tensile force is applied thereto and to an image display apparatus using the same.

BACKGROUND ART

A color picture tube has, as shown in FIG. 1, a structure including an envelope constructed by a panel 52 and a funnel 53 joined to the panel 52. In the periphery of the panel 52, a side wall 51 is formed. A phosphor screen 54 having three colors of R, G, and B is formed on the inner face of the panel effective portion. A shadow mask 55 in which a number of electron beam-passing apertures are formed is disposed so as to face the phosphor screen 54. The funnel 53 has a neck 56 in which an electron gun 57 for emitting three electron beams is disposed. By deflecting the three electron beams by a magnetic field generated by a deflection yoke 80 attached on the outside of the funnel 53, and by horizontally and vertically scanning the phosphor screen 54 via the shadow mask 55, a color image is displayed.

From the viewpoint of a smaller amount of entering external light and good looking, the panel of a recent color picture tube is being flattened and the shadow mask 55 is being accordingly flattened. When the shadow mask 55 is flattened, the plane of the shadow mask 55 cannot be maintained only by supporting the body of the shadow mask 55 by a frame 58. When the shadow mask 55 is simply supported only by the frame 58, the shadow mask 55 easily vibrates by external vibration, so that an adverse influence is exerted on a display image of the color picture tube. Consequently, the shadow mask 55 is stretched across the frame 58 in a state where a tensile force is applied thereto.

In a doming phenomenon that the surface of the shadow mask 55 is thermally deformed by collision of electron beams with the shadow mask 55, when the shadow mask 55 is flattened, a displacement amount of the electron beam becomes large especially around both the left and right edge faces of the screen. In order to absorb the thermal expansion caused by the collision of electron beams, a practically maximum tension close to the elastic limit is applied to the shadow mask 55.

In order to display an accurate color image on the phosphor screen 54 in such a color picture tube, it is necessary to hold the shadow mask 55 in a predetermined alignment relationship to three-color phosphor layers constructing the phosphor screen 54. One of the factors that deteriorate the alignment relationship between the shadow mask 55 and the phosphor screen 54 is vibration of the shadow mask 55. Although a tensile force is applied to the shadow mask 55 as described above, it is difficult to completely suppress the vibration of the shadow mask 55 only by the tensile force. The vibration of the shadow mask 55 occurs when external vibration or impact (for example, the vibration of a loudspeaker disposed on a side of the panel 52) is transmitted from the panel 52 via an elastic support member 59 and the frame 58 to the shadow mask 55. When the shadow mask 55 vibrates, the distance between the shadow mask 55 and the phosphor screen 54 changes, and thereby a landing displacement of the electron beam occurs. It is consequently desired that the vibration of the shadow mask 55 be attenuated as much as possible in a short time.

In order to suppress the vibration of the shadow mask 55, it is necessary to suppress the vibration of the shadow mask 55 itself and the vibration of the frame 58.

As a method of suppressing the vibration of the shadow mask 55 itself, a case where a damper is provided on an edge face of the shadow mask 55 has been reported. FIG. 2 shows an example of the damper. This damper 61 has a structure obtained by bending the ends of a wire. The damper 61 is provided by passing the bent portions into openings 62 in the shadow mask 55. The size of the opening 62 in the shadow mask 55 is set so that the damper 61 can freely vibrate. When the shadow mask 55 vibrates, a part of the energy for vibrating the shadow mask 55 is used to vibrate the damper 61, so that the vibration of the shadow mask 55 is attenuated. Even the structure in which such dampers 61 are provided is insufficient to demonstrate a vibration attenuating effect over the entire shadow mask 55.

On the other hand, in order to suppress the vibration of the frame 58, it is necessary to add a function such that the vibration can be absorbed by converting the vibration energy of the frame 58 to, for example, thermal energy (hereinbelow, called a damper function). As is disclosed in Japanese Unexamined Patent Publication No. 9-293459, a conventional method in which a sliding portion is provided with the elastic support member 59 itself so as to suppress the vibration of the frame 58 by the generated friction has been reported. FIGS. 3A and 3B show the structure of the elastic support member disclosed in Japanese Unexamined Patent Publication No. 9-293459. FIG. 3A is a front view and FIG. 3B is a side view. The structure has a matching portion 65 having a matching opening 64 to be matched to a stud pin 63, a fixed portion 66 to be fixed to the frame 58, and connecting portions 67 for connecting the matching portion 65 and the fixed portion 66. The connecting portions 67 are joined together by welding in their mid-portions so as to form a V shape. The fixed portion 66 has a blade 68 that is inserted into an opening 69 formed in the matching portion 65. When the elastic support member expands and contracts in the directions indicated by the two-headed arrow as the frame vibrates, the blade 68 slides in the opening 69, thereby obtaining a damper function. However, such an elastic support member has a complicated structure and is not easily produced. Due to a problem of a high cost, it is difficult to actually adopt the elastic support member.

In addition, the shadow mask 55 has to be attached and detached a plurality of times during a process of forming the phosphor screen 54 by a photo printing method using the shadow mask 55 as a photo mask. Consequently, the elastic support member 59 for holding the frame 58 across which the shadow mask 55 is stretched in a state where a tensile force is applied thereto has to be easily attached and detached in the same position with excellent reproducibility.

Further, in addition to the suppression of the vibration, the elastic support member 59 is required to have the following characteristics:

(1) improvements in terms of doming characteristic and low/high temperature characteristic; and (2) assurance of impact resistance.

Doming characteristic (phenomenon) of (1) is a phenomenon such that the temperature of the shadow mask 55 rises due to the collision of electron beams as described above, creating a temperature difference between the shadow mask 55 and the panel 52 (usually made of glass), and therefore the predetermined alignment relationship deteriorates due to a thermal expansion coefficient difference between the material of the shadow mask 55 and that of the panel 52. Low/high temperature characteristic is similar to doming characteristic and is a phenomenon such that a positional alignment relationship between the shadow mask 55 and the panel is displaced due to the temperature difference between the shadow mask 55 and the panel 52 caused by the ambient temperature of the panel 52. Both of the characteristics are phenomena that the positional alignment relationship between the shadow mask 55 and the panel 52 is displaced due to the temperature difference between them. The phenomena cause a color shift and color unevenness. The displacements cannot be completely compensated even if a tensile force is applied to the shadow mask 55. When the shadow mask 55 expands relatively, the displacements between the shadow mask 55 and the inner face of the panel 52 on which the phosphor screen 54 is formed has to be compensated by shortening the distance between the shadow mask 55 and the inner face of the panel 5. On the contrary, when the panel 52 expands, it is necessary to widen the distance between the shadow mask 55 and the panel 52. In this manner, the elastic support member 59 has to have the function of displacing the position of the shadow mask 55 in accordance with the temperature difference between the panel 52 and the shadow mask 55.

At the time of carrying the color picture tube, there is a case such that the color picture tube is subjected to an impact that cannot be imagined in a normal use state due to an unexpected event (such as collapse of a cargo). When the shadow mask 55 is displaced due to plastic deformation of the elastic support member 59 or buckling of the matching portion by the impact, the positional alignment relationship between the shadow mask 55 and the panel 52 is displaced. The elastic support member 59 therefore has to be strong enough not to cause a displacement in the shadow mask 55 even when a specific impact (acceleration) is applied.

The structure including the frame, the shadow mask, and the elastic support member (hereinbelow, called a frame structure) is desired to have overall excellent characteristics with respect to the suppression of the vibration of the shadow mask, doming and low/high temperature characteristics and impact resistance.

An example of the conventional frame structure will be described hereinbelow. FIG. 4A is an entire view showing a state where a frame 58 is disposed in the panel 62 with strip-shaped elastic support members 59. FIG. 4B is an enlarged view of the strip-shaped elastic support member 59. The strip-shaped elastic support member 59 has a catching portion 60(*a*) to be caught by a stud pin 63 of the panel 62, a fixed portion 60(*b*) to be fixed to the frame, and a connecting portion 60(*c*) for connecting the catching portion 60(*a*) and the fixed portion 60(*b*). Such a strip-shaped elastic support member is called a TCM type and has a characteristic of excellent impact resistance. As a countermeasure against doming and low/high temperature characteristics, the elastic support member has a bimetallic structure made of two kinds of materials a (hatched portion) and β (not-hatched portion) having different thermal expansion coefficients. The bimetallic effect of the elastic support member 59 is not, however, displayed unless the temperature of the elastic support member 59 itself changes. Therefore, there is a problem of a slow response to a change in environment or a sudden rise in temperature of the shadow mask. Since the temperature change amount of the elastic support member 59 is small, a large correction amount cannot be set. Consequently, there is another problem that a material of the shadow mask having a thermal expansion coefficient largely different from that of the material of the panel cannot be used.

In the frame structure, since corners 74 of the frame 58 are not supported, vibration easily occurs. Moreover, since the elastic support member of the TCM type has no damper effect, once vibration occurs, it is not attenuated easily. As a result, the shadow mask also vibrates, thereby causing a problem that an adverse influence such as a color shift is exerted on the picture quality.

FIG. 5A shows a frame structure of another conventional technique. As shown in FIG. 5, stud pins 71 are provided on the inner walls at the opposite corners of a panel 70. Each of elastic support members 72 has a catching portion 72(*a*) to be caught by the stud pin 71, a fixed portion 72(*b*) fixed to a frame, and a V-shaped connecting portion 72(*c*) for connecting the catching portion 72(*a*) and the fixed portion 72(*b*). The connecting portion 72(*c*) is attached to the phosphor screen side. However, the configuration has the following problems.

(1) The clearance between the panel 70 and the frame 73 is narrow since the elastic support members 72 are disposed at the opposite corners of the panel 70, so that the assembling is difficult. It is not easy to assemble the frame 73 to the panel 70, and reduction in yield due to damage in the elastic support member 72, the stud pin 71, and the panel 70 is a problem.

(2) Since the elastic support members 72 are disposed at the opposite corners of the panel 70, the elastic support member 72 cannot be widened. Consequently, the impact resistance is poor.

DISCLOSURE OF THE INVENTION

The present invention is intended to solve the conventional problems mentioned above and provide a color picture tube that is resistant to external vibration and is excellent in terms of doming and low/high temperature characteristics and impact resistance, and has a suitable configuration for easy assembling, and an image display apparatus using the color picture tube.

The first aspect of the present invention is a cathode ray tube comprising, at least, a panel having a phosphor screen formed thereon, a shadow mask having a plurality of electron beam-passing portions, and a frame across which the shadow mask is stretched in a state where a tensile force is applied thereto, the frame being securely attached to the panel by an elastic support member while the phosphor screen is opposed to the shadow mask, wherein the elastic support member is located substantially in the middle portion of a frame portion and the shadow mask is configured such that the tension in the middle portion of the shadow mask is larger than the tension at the edge portions of the shadow mask.

In the configuration described above, since the elastic support member is located substantially in the middle portion of the frame portion, the assembly and frame support may be improved, and since the tension in the middle portion of the shadow mask is larger than the tension at the edge portions of the shadow mask, the vibration attenuating effect of the elastic support member may be found not only at the edge portions of the shadow mask but also at the middle portion of the shadow mask.

The second aspect of the present invention is a cathode ray tube comprising, at least, a panel having a phosphor screen formed thereon, a shadow mask having a plurality of electron beam-passing portions, and a frame across which the shadow mask is stretched in a state where a tensile force is applied thereto, the frame being securely attached to the panel by an elastic support member while the phosphor screen is opposed to the shadow mask, wherein the elastic support member is fixed to an elastic support member-holding plate located substantially in the middle of the frame portion and the shadow mask is configured such that the tension in the middle portion of the shadow mask is larger than the tension at the edge portions of the shadow mask.

In the configuration described above, since the elastic support member is fixed to the elastic support member-holding plate located substantially in the middle of each frame portion, the elastic support members are located in the same plane by adjusting the extension direction of the elastic support member-holding plate even when the frame portions are not in the same plane, and therefore the effects of the first aspect of the present invention are demonstrated further.

In these first and second aspects of the present invention described above, the elastic support member desirably comprises a fixed portion to be fixed to the frame, a matching portion to be matched to a stud pin provided on the inside of the panel side wall, and a connecting portion for connecting the matching portion and the fixed portion. The connecting portion preferably has an approximately V-shaped configuration. With this configuration, better doming and low/high temperature characteristics may be obtained.

In this configuration, the fixed portion of the elastic support member preferably has an area of at least 5 $cm^2$. This is because when the area of the fixed portion is made large, a force applied to the frame is dispersed, and this prevents the tension distribution pattern of the shadow mask from varying due to the frame deformation. To increase the effect described above, the ratio of the area of the fixed portion of the elastic support member to the area of the frame portion to which the elastic support member is fixed is preferably at least greater than 1/25.

Furthermore, the elastic support member desirably includes a vibration suppressing structure, because the vibration of the frame is transmitted to the shadow mask even when the vibration of the shadow mask is attenuated unless the vibration of the frame is attenuated.

The spring constant of the elastic support member may be altered relatively easily without changing the size of the elastic support member by is forming an opening in the connecting portion of the elastic support member and adjusting the size of the opening.

The force applied to the frame portion by the elastic support member is preferably in the range of 1 kgf to 8 kgf and the spring constant of the elastic support member is preferably in the range of 0.1 kgf/mm to 2.5 kgf/mm.

The stretched shadow mask is provided with a damper for attenuating the vibration and has a tension distribution such that the tension is largest in the middle portion of the shadow mask and decreases gradually toward the edge portions to ensure that the vibration may be attenuated in the entire shadow mask. In order to extend the attenuating effect of the damper to the entire shadow mask, it is preferable that the tension distribution satisfy the relationships $T1 \geqq T2 \geqq T3$ and $T1 \geqq 1.1 \times T3$, where the tension of the shadow mask middle portion is T1, the tension of the shadow mask edge portions is T3, and the tension of the intermediate portions between the middle and the edge portions is T2.

Preferably, the damper has a structure that is freely movable with no portion thereof fixed to the shadow mask in order to improve the attenuating effect.

Specifically, the damper is preferably so constructed as to be inserted into an opening formed in the shadow mask and is preferably a wire-like member or a ring-like member.

As the material for the shadow mask, Fe—Ni alloy is preferable since its creeping rate is small even when heated to higher temperatures.

The third aspect of the present invention is a cathode ray tube comprising, at least, a panel having a phosphor screen formed thereon, a mask having a plurality of electron beam-passing portions, and a frame on which the mask is held, the frame being securely attached to the panel by a plurality of elastic support members while the phosphor screen is opposed to the mask, wherein the plurality of elastic support members are such that at least two elastic support members having substantially different spring constants are combined.

In the composition described above, when the plurality of elastic support members are such that at least two elastic support members having substantially different spring constants are combined, single vibration mode, in which the vibration is easily suppressed, predominates, and therefore the vibration of the frame may be suppressed.

In this third aspect of the present invention described above, desirably, each of the elastic support members is located substantially in the middle of a frame portion to suppress the vibration of the mask.

To obtain better doming and low/high temperature characteristics, desirably, the elastic support member comprises a fixed portion to be fixed to the frame, a matching portion to be matched to a stud pin provided on the inside of the panel side wall, and a connecting portion for connecting the matching portion and the fixed portion. The connecting portion preferably has an approximately V-shaped configuration.

Of the elastic support members, opposing elastic support members desirably have the same spring constant in order to increase the intensity of single vibration further.

The fixed portion of the elastic support member preferably has an area of at least 5 $cm^2$. This is because when the area of the fixed portion is made large, the force applied to the frame is dispersed, and this prevents the tension distribution pattern of the shadow mask from varying due to the frame deformation. To increase this effect described above, the ratio of the area of the fixed portion of the elastic support member to the area of the frame portion to which the elastic support member is fixed is preferably at least greater than 1/25.

The elastic support member desirably includes a vibration suppressing structure, because the vibration of the frame is transmitted to the shadow mask even when the vibration of the shadow mask is attenuated unless the vibration of the frame is attenuated.

The spring constant of the elastic support member may be altered relatively easily without changing the size of the elastic support member by forming an opening in the connecting portion of the elastic support member and adjusting the size of the opening.

The force applied to the frame portion by the elastic support member is preferably in the range of 1 kgf to 8 kgf and the spring constant of the elastic support member is preferably in the range of 0.1 kgf/mm to 2.5 kgf/mm.

Preferably, the mask is stretched across the frame in a state where a tensile force is applied thereto, and more preferably, the tension in the middle portion is larger than the tension at the edge portions in the tension distribution of the mask. The reason for this is that the stretched shadow mask is provided with a damper for attenuating the vibration and has the tension distribution in which the tension is largest in the middle portion of the shadow mask and decreases gradually toward the edge portions to ensure that the vibration may be attenuated in the entire shadow mask. In order to extend the attenuating effect of the damper to the entire shadow mask, it is more preferable that the tension distribution satisfy the relationships $T1 \geqq T2 \geqq T3$ and $T1 \geqq 1.1 \times T3$, where the tension of the shadow mask middle portion is T1, the tension of the shadow mask edge portion is T3, and the tension of the intermediate portions between the middle and the edge portions is T2.

Preferably, the damper has a structure which is freely movable with no portion thereof fixed to the shadow mask in order to increase the attenuating effect.

Specifically, the damper is preferably so constructed as to be inserted into an opening formed in the shadow mask and is preferably a wire-like member or a ring-like member.

As the material for the shadow mask, Fe—Ni alloy is preferable since its creeping rate is small even when heated to higher temperatures.

Furthermore, the first, second, and third aspects of the present invention described above may be applied not only to the foregoing cathode ray tube but also to a general image display apparatus such as a television set which includes an electron beam controlling circuit, a cabinet, and the like in addition to the cathode ray tube.

BRIEF DESCRIPTION OF THE DRAWINGS

FIG. 3A is a front view thereof and FIG. 3B is a side view thereof.

FIG. 4A is a front view thereof and FIG. 4B is an enlarged perspective view thereof.

FIG. 5A is a front view thereof and FIG. 5B is an enlarged perspective view thereof.

FIG. 8 is a phase diagram showing one example of a tension distribution of a shadow mask.

FIG. 13 is a view showing a variation of the elastic support member.

FIG. 14 is a view showing another variation of the elastic support member.

BEST MODE FOR CARRYING OUT THE INVENTION

Figure 1:
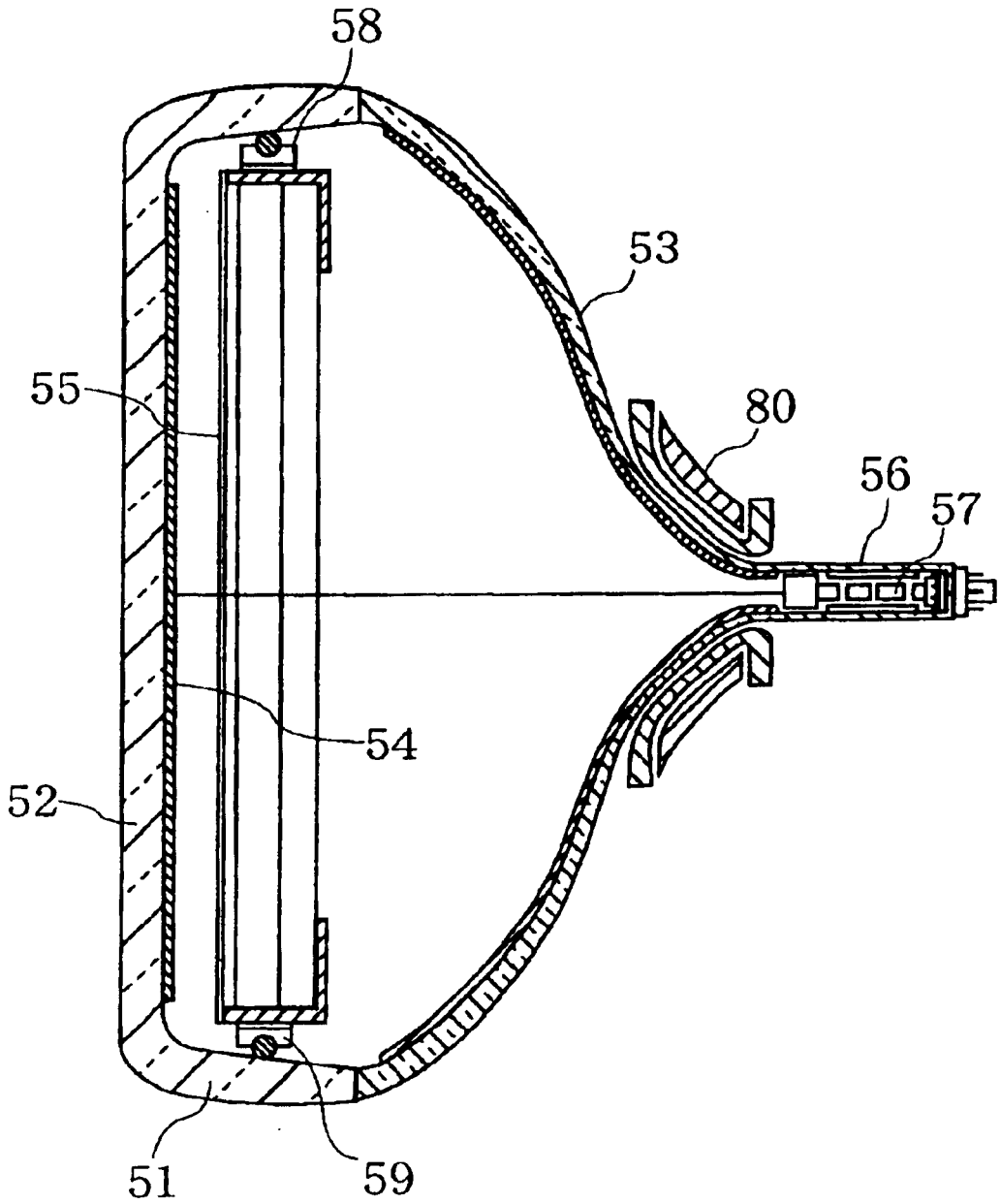
FIG. 1 is a cross sectional view showing a color picture tube.
Figure 2:
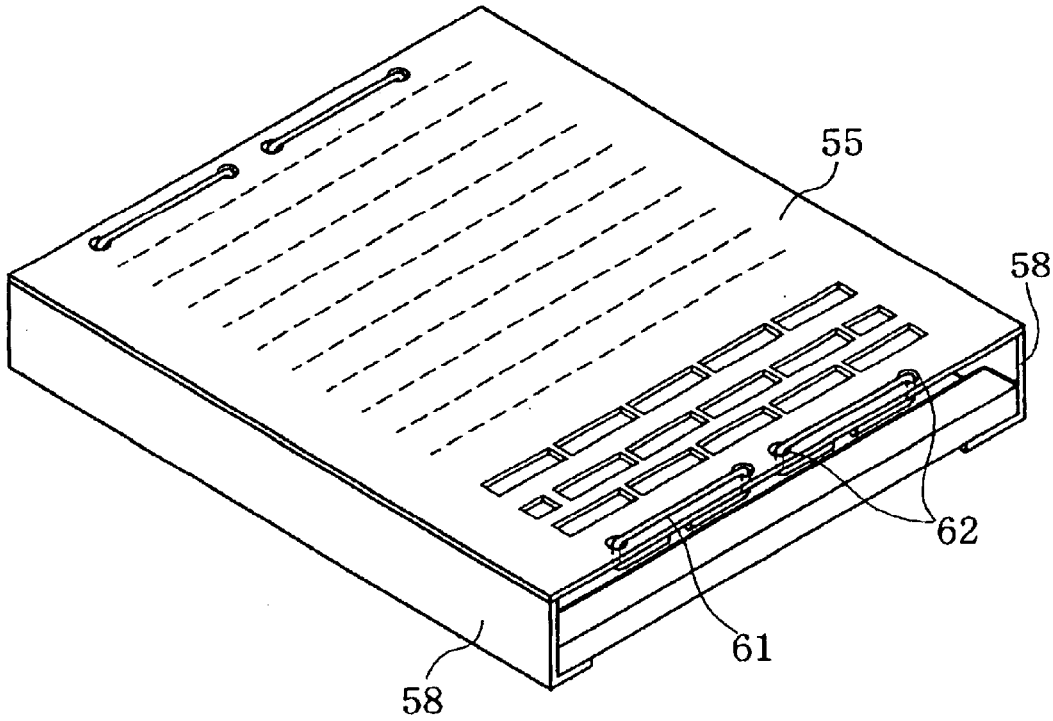
FIG. 2 is a perspective view showing a shadow mask in which a damper of a conventional color picture tube is provided.
Figure 3A:
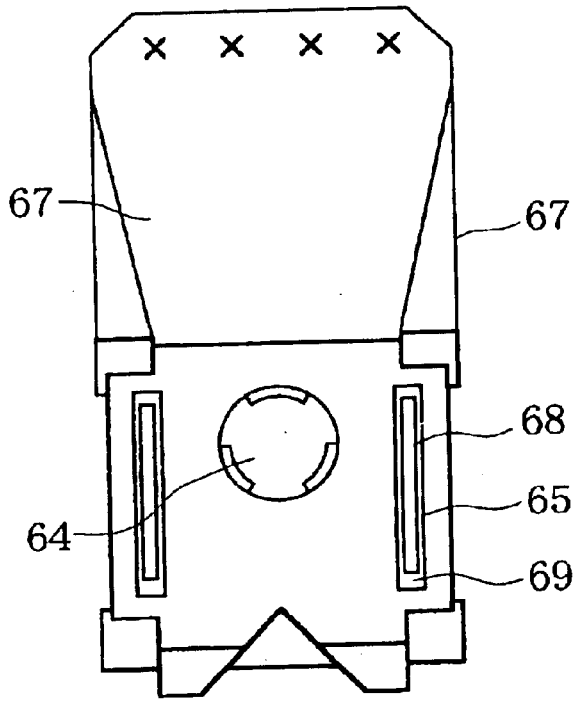
FIGS. 3A and B are views showing a conventional elastic support member provided with a damper function.
Figure 3B:
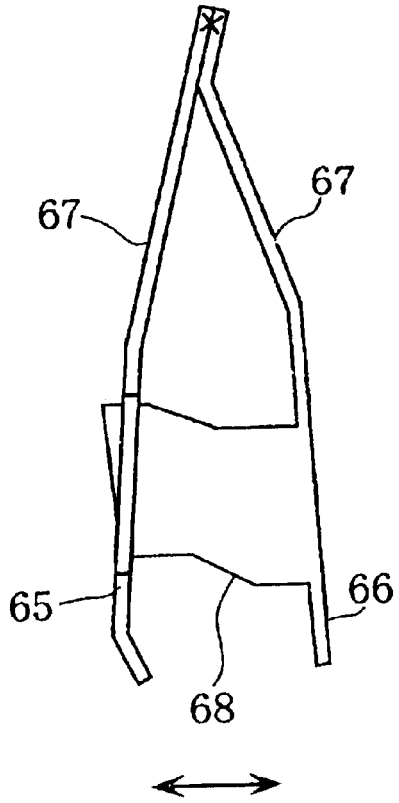
Figure 4A:
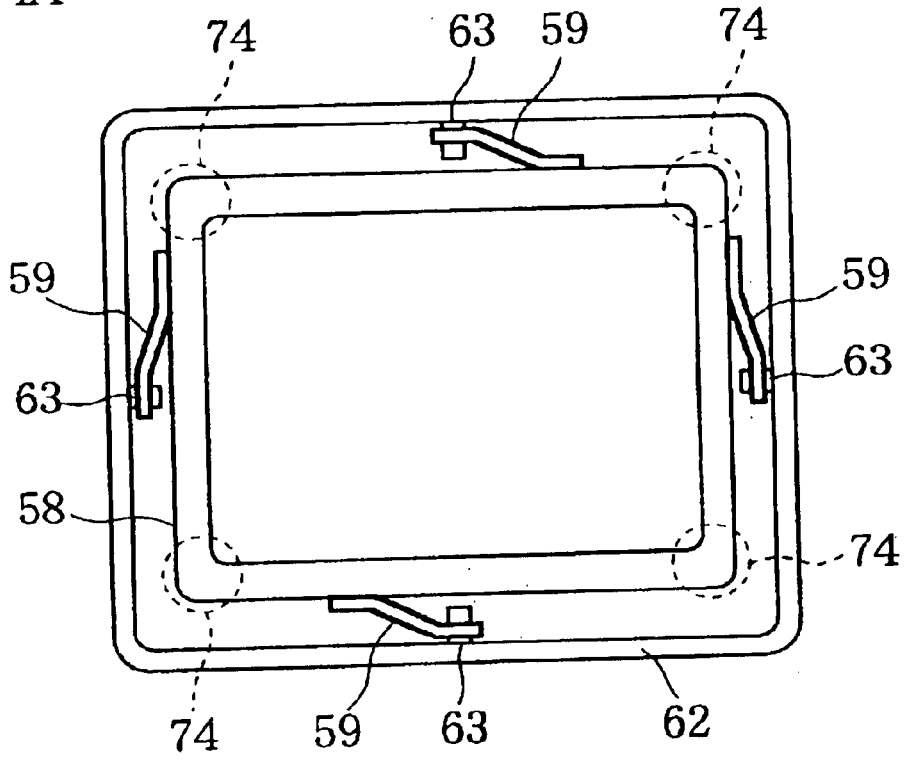
FIGS. 4A and B are views showing the structure of a conventional color picture tube.
Figure 4B:
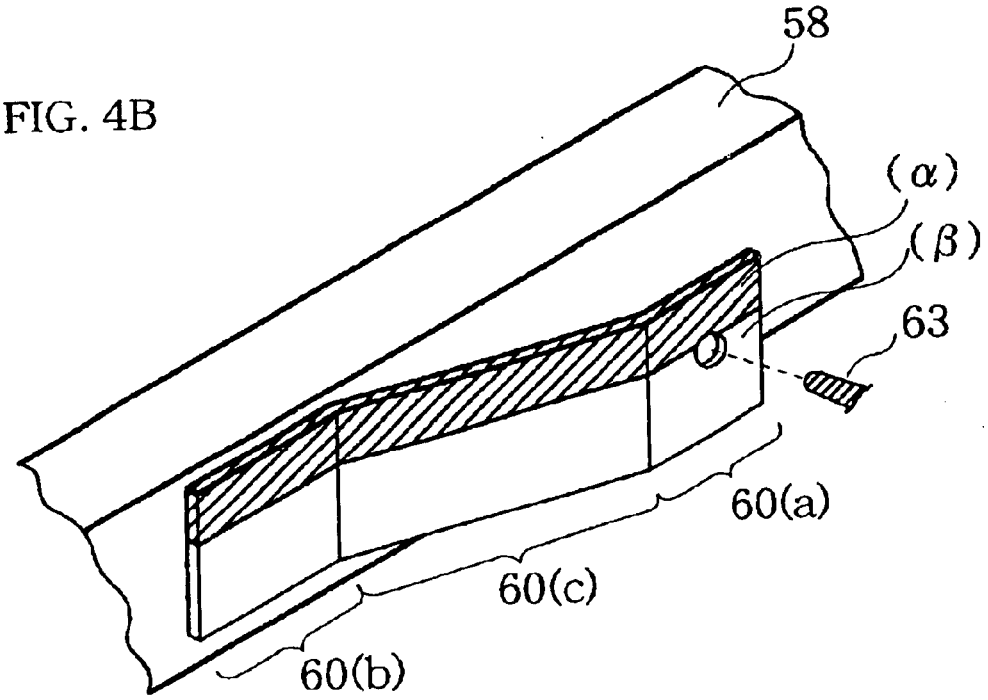
Figure 5A:
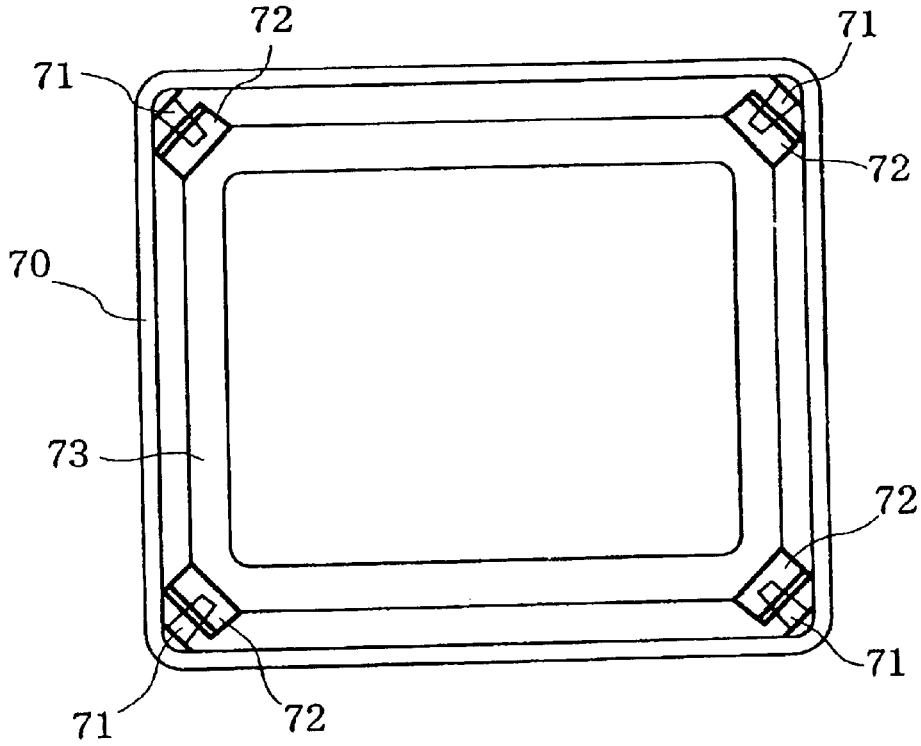
FIGS. 5A and B are views showing the structure of a conventional color picture tube.
Figure 5B:
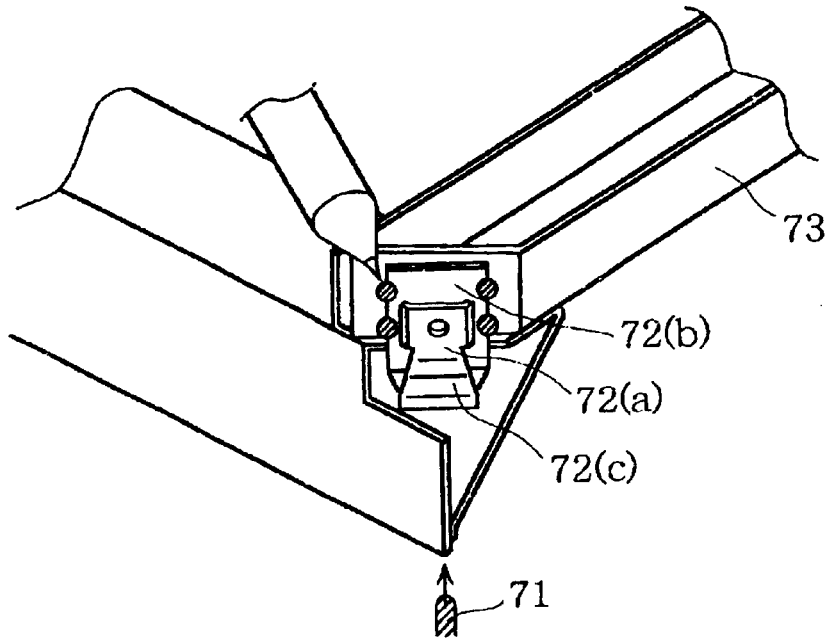

Embodiments of the present invention will now be explained in details with reference to the drawings. The shadow mask of the color picture tube explained hereinbelow is a flat-faced mask, and the constructioin of the color picture tube having been explained with reference to FIG. 1 also applies to the following embodiments.

EMBODIMENT 1

Figure 6:
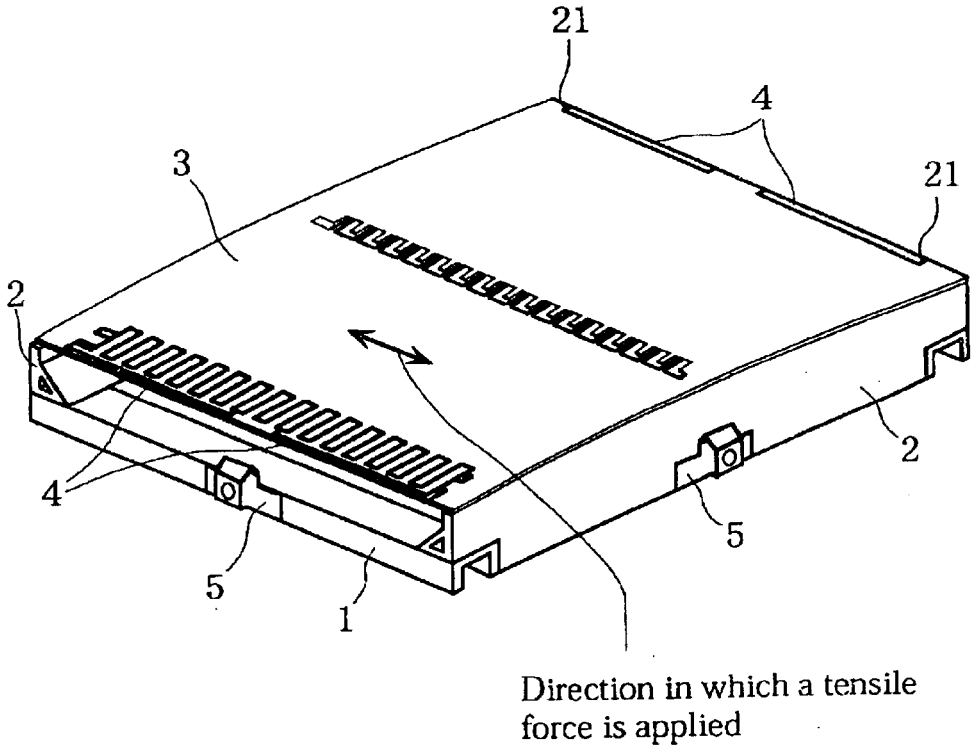
FIG. 6 is a perspective view illustrating Embodiment 1.

FIG. 6 is a perspective view of frame portions according to Embodiment 1 of the present invention. In FIG. 6, reference numeral 1 denotes left and right frame portions, and reference numeral 2 upper and lower frame portions wherein a shadow mask 3 is stretched in a state where a tensile force is applied in vertical directions (as indicated by the two-headed arrow). Wire-like dampers 4 for attenuating the vibration of the shadow mask are provided on left and right edge surface portions of the shadow mask 3. In the embodiment, a 29-inch frame is used and the shadow mask 3 has a tension distribution set to 4.3 $kgf/mm^2$ for the middle portion, 3.4 $kgf/mm^2$ for the left and right edge surface portions, and 3.6 $kgf/mm^2$ for intermediate portions between the middle portion and the left and right edge surface portions. 36% Ni—Fe alloy was employed for manufacturing the shadow mask 3.

Figure 7:
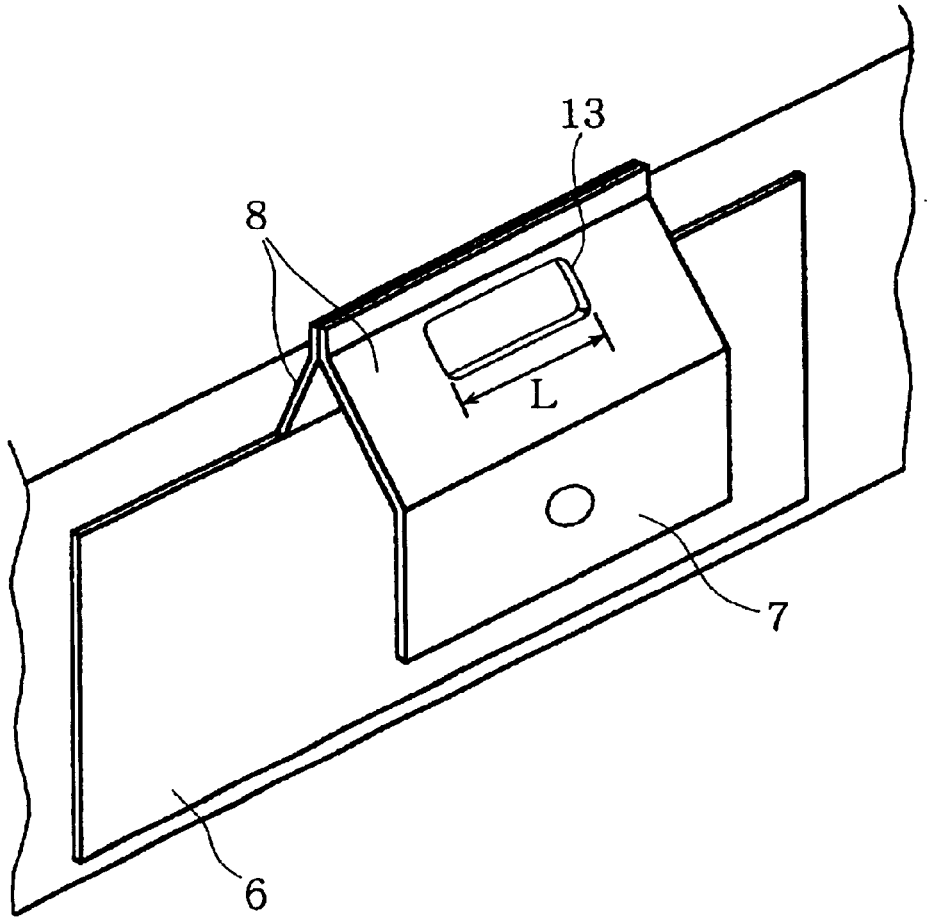
FIG. 7 is a perspective view showing an elastic support member used in Embodiment 1.

Elastic support members 5 for attaching the frame to the panel are located substantially in the middle portions of the frame portions 1,2 in view of assembly and support of the frame portions 1, 2 {on-axial SP (spring) structure}. FIG. 7 illustrates an enlarged view of the elastic support member 5 employed in the embodiment. The elastic support member 5 comprises a fixed portion 6 to be fixed to the frame portion, a matching portion 7 to be matched to a stud pin provided on the inside of the panel side wall, and a V-shaped connecting portion 8 for connecting the fixed portion 6 and the matching portion 7, the connecting portion 8 having an opening 13. It is possible to determine a spring constant for the elastic support member 5 by varying the size of the opening 13 (particularly its length L) and the plate thickness of the connecting portion 8, wherein L is set to be 25 mm, the plate thickness 0.6 mm and the spring constant 1.2 kgf/mm in the embodiment.

Figure 8A:
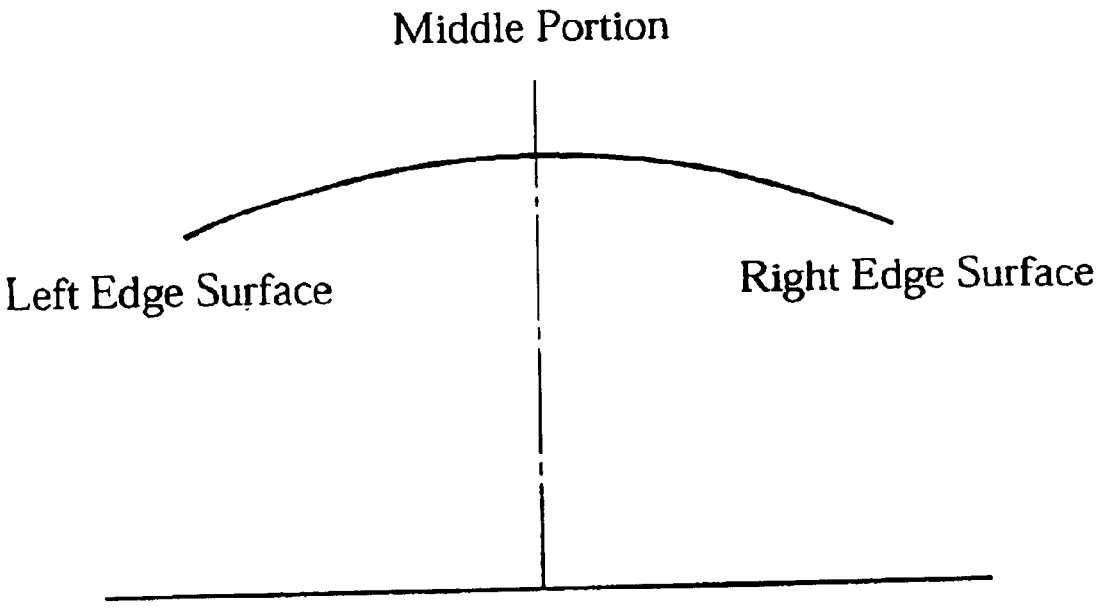
FIG. 8A is a view showing an A-type distribution.
Figure 8B:
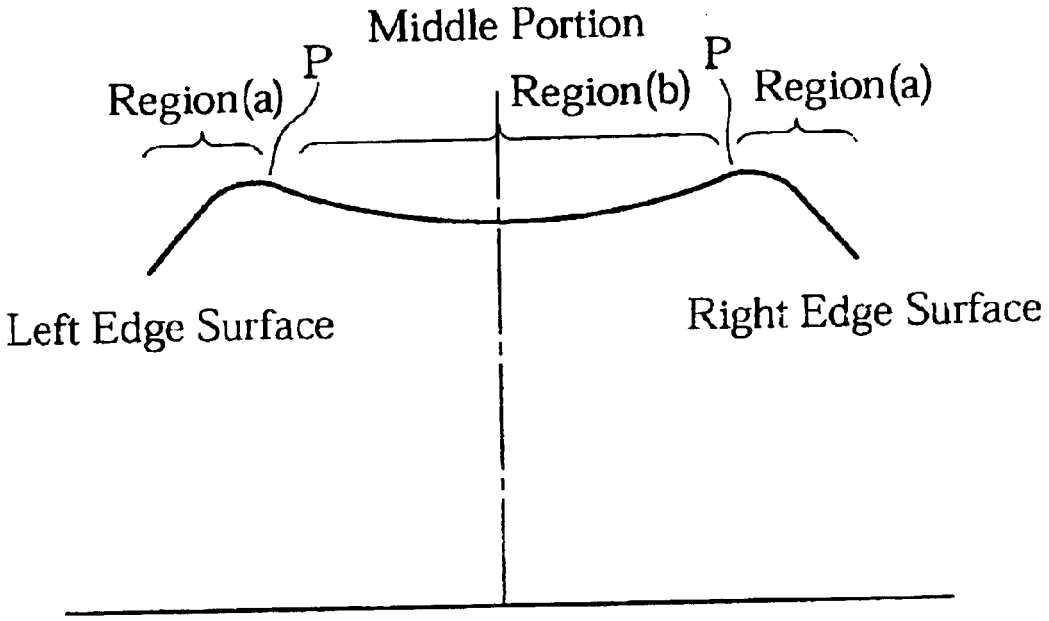
FIG. 8B is a view showing an M-type distribution.

For demonstrating the vibration attenuating effect over the entire shadow mask 3, it is desirable that the tension distribution be such that the tension in the middle portion of the shadow mask is largest while it becomes gradually lower toward the edge portions (hereinafter referred to as "A-type distribution") as illustrated in FIG. 8A. This is because in a distribution such that a tension peak is obtained somewhere other than the middle portion (hereinafter referred to as "M-type distribution") as is shown in FIG. 8B, the vibration attenuating effect owing to dampers do not cover the region (b) of the middle portion while the vibration attenuating effect are recognized on the regions (a) extending from the edge portions up to where the peak tension is obtained. This is due to the fact that spot P where the peak tension is achieved vibrates as being a node so that the extension of the vibration attenuating effect of the dampers are suppressed at the tension peak. It should be noted that the vibration attenuating effect is prevented from expanding due to similar reasons even when the shadow mask includes wrinkles or irregularities in tension.

Experiments

The above-described shadow mask frame was assembled into a CRT and evaluated. The results are indicated in Table 1. It should be noted that this Table 1 also includes the results obtained by using strip plate-like elastic support members of the prior art (hereinafter referred to as "TCM type") and those illustrated in Embodiment 2.

TABLE 1

Results on Characteristics Evaluation (29-inch)

| | | Embodiment 1 | | Embodiment 2 | | Prior Art (TCM type) | |
|---|---|---|---|---|---|---|---|
| Item | Targets | Results | Assess-ment | Results | Assess-ment | Result | Assess-ment |
| Vibration tapping test *1 | Color shift continuity 2 sec or less | 1.5 sec | Good | 1.6 sec | Good | 1 sec | Good |
| Loudspeaker test *2 | No color shift | No color shift | Good | No color shift | Good | No color shift | Good |
| Low/high temperature Characteristic | 1 μm/° C. or lower | 0.9 μm/° C. | Good | 1 μm/° C. | Good | 1.5 μm/° C. | Poor |
| Overall doming | 30 μm or less | 20–30 μm | Good | 28 μm | Good | 40 μm | Poor |
| Drop (impact-resistance) test (35 G: 40 ms) | Displacement amount of frame position 20 μm or less | 15–20 μm | Good | 20 μm | Good | 100 μm or greater | Poor |

As it is evident from Table 1, the targets in all items were attained, and the frame proved to be strong against external vibration and to be superior in terms of doming and low/high temperature characteristics as well as impact resistance. The frame may also be easily assembled since it is of on-axial SP structure, and a fraction defective during the process of attaching the frame to the panel (including photolithograph process) was remarkably decreased to be not more than 1/10.

The conventional TCM type elastic support member was not sufficient in terms of doming characteristic, low/high temperature characteristic, and impact resistance. Therefore, an elastic support member having the above-mentioned construction (hereinafter referred to as "mechanical type") is desirable.

Figure 9:
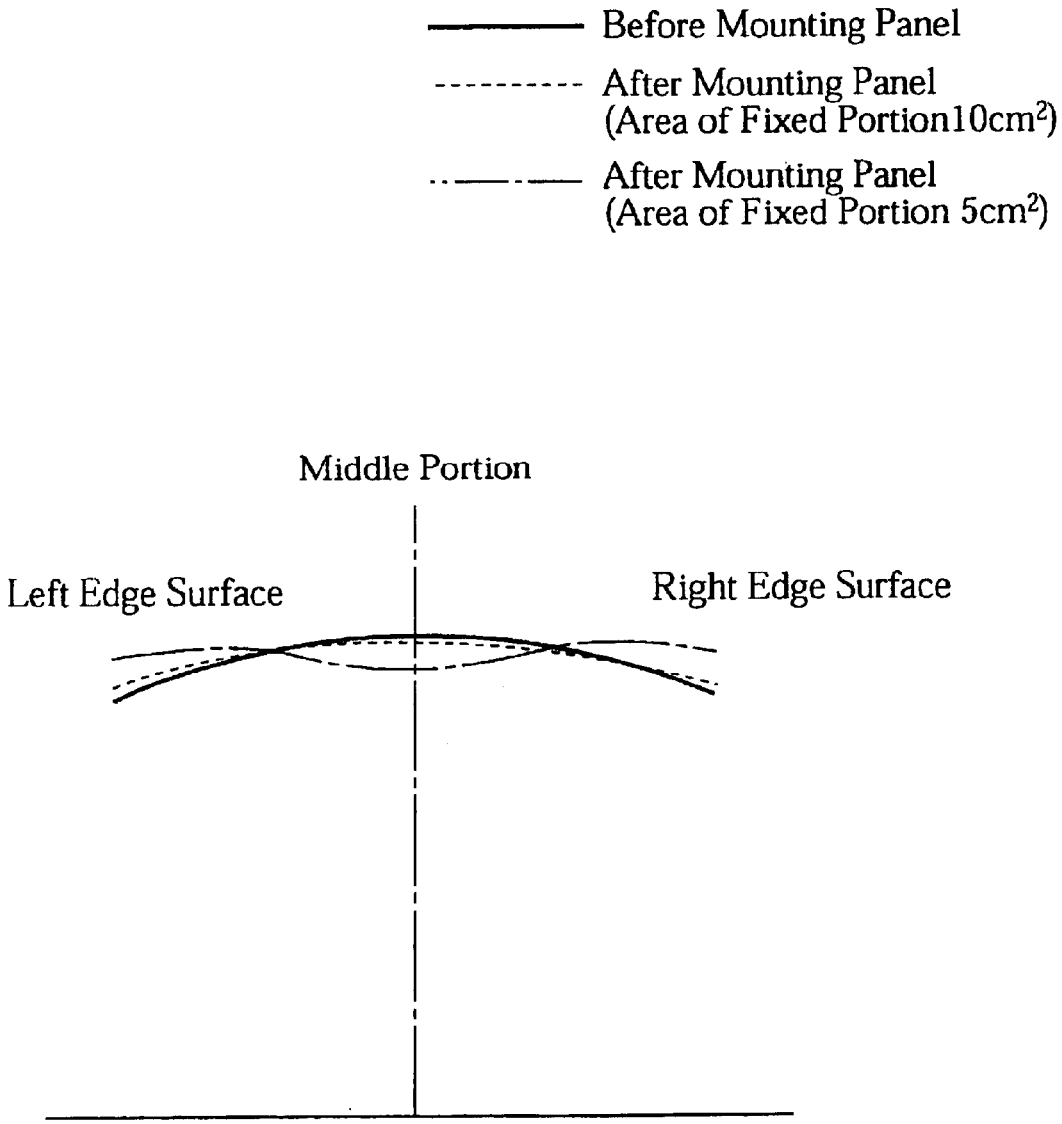
FIG. 9 is a phase diagram showing changes in the tension distribution of a shadow mask.

Supplementary Remarks (1) While the area of the fixed portion 6 of the elastic support member 5 in which is fixed to the frame as employed in Embodiment 1 was set to be 10 $cm^2$, but the present invention is not limited to this value. It should, however, be noted that this area be desirably as large as possible, and preferably 5 $cm^2$ at the minimum. This is because a small area of the fixed portions 6 may result in deformation of the frame since the force applied on the frame by the elastic support member 5 focuses thereon and thereby changes the pattern of the tension distribution of the shadow mask 3 as illustrated in FIG. 9. As has been explained, changes in the tension distribution pattern are not preferable since they create regions in which the vibration of the shadow mask is hard to be attenuated. For these reasons, the area of the fixed portion 6 of the elastic support member 5 in which is fixed to the frame is desirably as large as possible, and preferably 5 $cm^2$ at the minimum.

(2) While it is possible to prevent the vibration of the shadow mask 3 by setting the area of the fixed portion 6 of the elastic support member 5 in which is fixed to the frame to be larger than 5 $cm^2$, as described above, in Embodiment 1 (wherein the panel size is of 29-inch), this method is also applicable to panels of different sizes. It has been confirmed through experiments that similar effects may be obtained by setting a ratio (A1/A2) of the area (A1 $cm^2$) of the fixed portion 6 of the elastic support member 5 to the area (A2 $cm^2$) of the frame portion to which the elastic support member 5 is fixed to be larger than 1/25.

(3) Although employed in Embodiment 1 is a mechanical type elastic support member 5 having a spring constant of 1.2 kgf/mm and the force applied to the frame portion when the frame is disposed in the panel is approximately 3.5 kgf, the mechanical type elastic support member 5 that may be applied to the present invention is not limited to this. However, the force applied to the frame portion is preferably in the range of 1 kgf to 8 kgf. This is because the disposing condition of the frame to the mask is unstable when the force is less than 1 kgf while the frame is deformed when the force exceeds 8 kgf, and the tension distribution of the shadow mask 3 changes into M-type whereby the vibration becomes hard to be attenuated.

It has thus been confirmed through experiments that it is preferable to set the spring constant of the mechanical type elastic support member 5 to be in the range of 0.1 kgf/mm to 2.5 kgf/mm for realizing the above-described disposing condition. Because a realizable maximum limit of the clearance between the frame and the panel is 20 mm (and smaller when the panel size is smaller), the spring constant needs to be not less than 0.1 kgf/mm for realizing the above-mentioned force for disposing. On the other hand, when the spring constant exceeds 2.5 kgf/mm, the spring constant rigidity becomes large enough not to cause the deformation, thereby remarkably worsening the assembling characteristics, and even when the same amount of force is applied, the deformation occurs only in a small amount. As a result, good doming characteristic and low/high temperature characteristic remarkably deteriorate.

Figure 10:
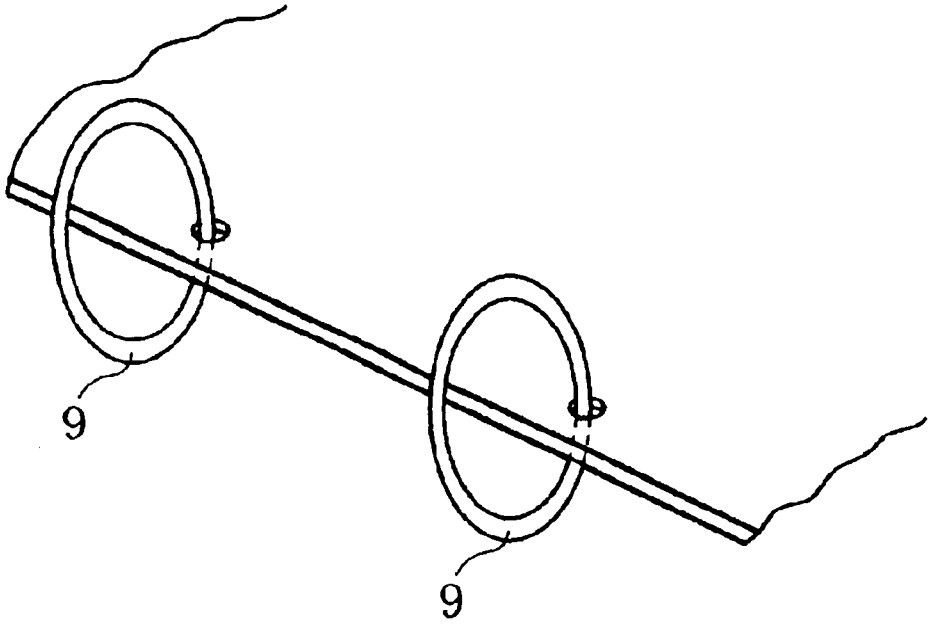
FIG. 10 is a perspective view showing one form of the dampers.
Figure 11:
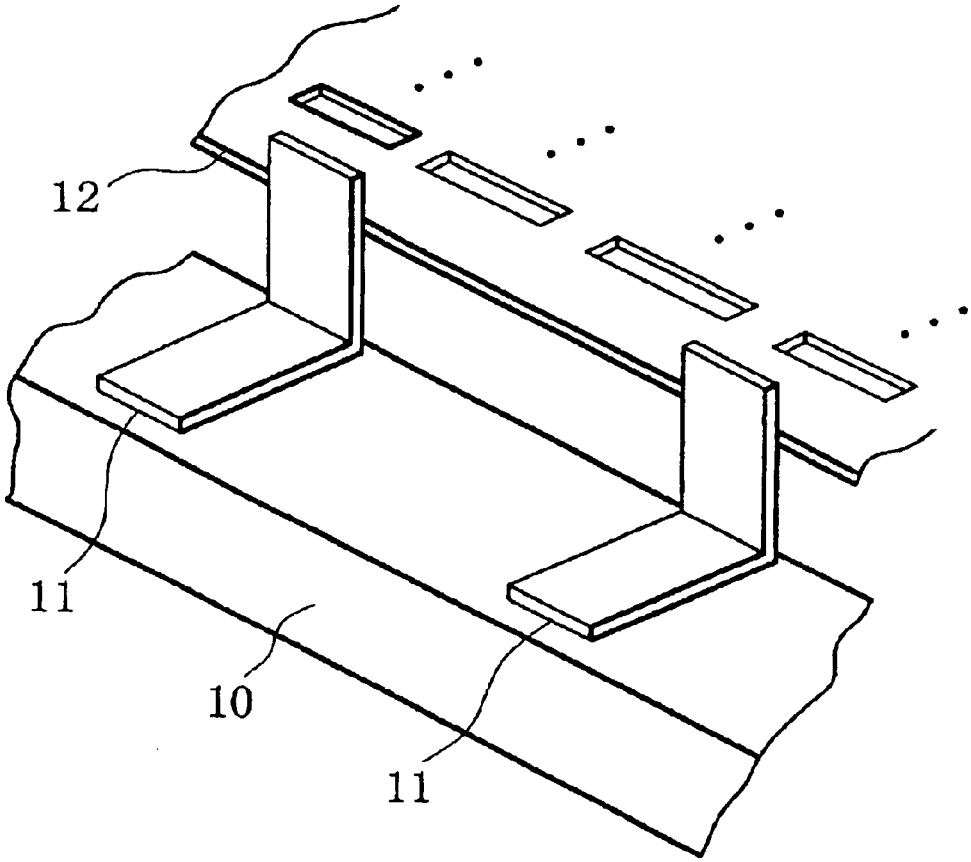
FIG. 11 is a perspective view showing another form of the dampers.

(4) While each damper 4 provided on the left and right edge surface portions of the shadow mask 3 is constructed such that a wire-like member is partially bent to be inserted into the opening 21 formed in the shadow mask 3 in Embodiment 1, the damper 4 applicable to the present invention is not limited to this type, and it may also be a ring-like member 9 illustrated in FIG. 10. It may alternatively be a damper 11 such that one portion thereof contacts an edge surface 12 of the shadow mask while another portion is fixedly attached to a frame 10 as illustrated in FIG. 11.

(5) The material for the shadow mask desirably has a small thermal creeping rate in a high temperature condition in a state where a tension is applied thereto. In a CRT manufacturing process, it is necessary to perform a plurality of high temperature heat treatment processes such as a heat process for easing the stress generated at the time of stretching the shadow mask, a fritting process of forming an exterior tube, and the like. In a construction in which the shadow mask with a tension applied is stretched across the frame, it is not preferable that the thermal creeping take place in the shadow mask during the heat treatment processes because phenomena such as a decrease in tension, a change in the tension distribution, wrinkles in the shadow mask, and the like occur. In order to absorb the thermal creeping, it is required to apply quite a large tension to the shadow mask. This involves an increase in the frame strength, thereby leading to other problems such as an increase in frame weight, more complicated and expensive stretching equipment, complications in the process, and the like. Thus, it is desirable to select, as the material for the shadow mask, a material such as Ni—Fe alloy (Invar material) as employed in Embodiment 1 or the like that exhibits a small thermal creeping rate in a high temperature condition in a state where a tension is applied thereto.

Figure 12:
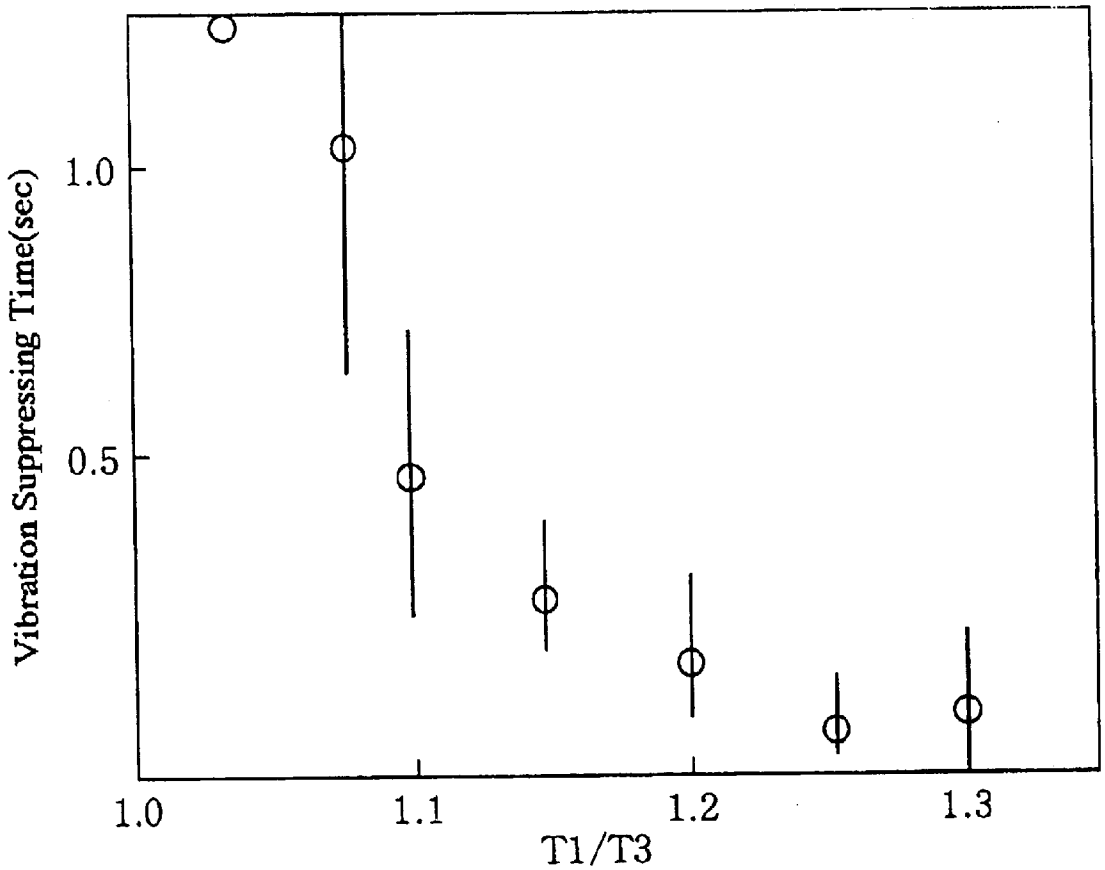
FIG. 12 is a graph showing the relationship between T1/T3 and vibration suppressing time.

(6) For expanding the vibration attenuating effect of the dampers over the entire shadow mask, it is preferable to set the tension distribution of the shadow mask so as to satisfy the relationships $T1 \geqq T2 \geqq T3$ and $T1 \geqq 1.1 \times T3$, where T1 is a tension at the middle portion of the shadow mask, T3 a tension at the edge portions, and T2 a tension of the intermediate portions between the middle portion and the edge portions. This is due to the fact that the vibration suppressing time becomes longer when the relationship $T1 < 1.1 \times T3$ is satisfied as illustrated in FIG. 12. Note that the vibration suppressing time means a time required for attenuating amplitude of vibration to 1/10 or lower.

Figure 13A:
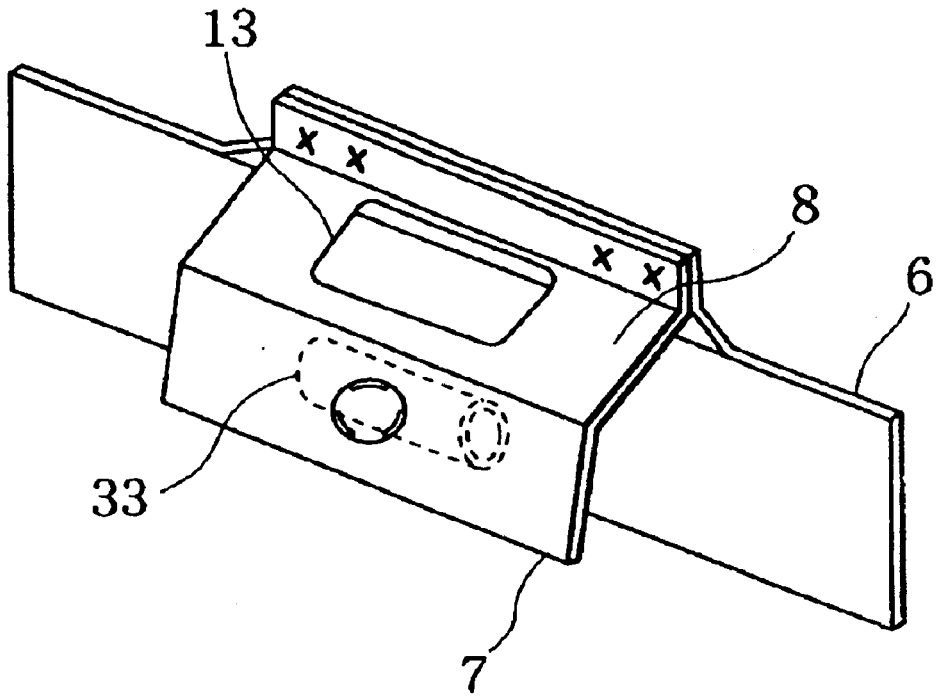
FIG. 13A is a perspective view thereof.
Figure 13B:
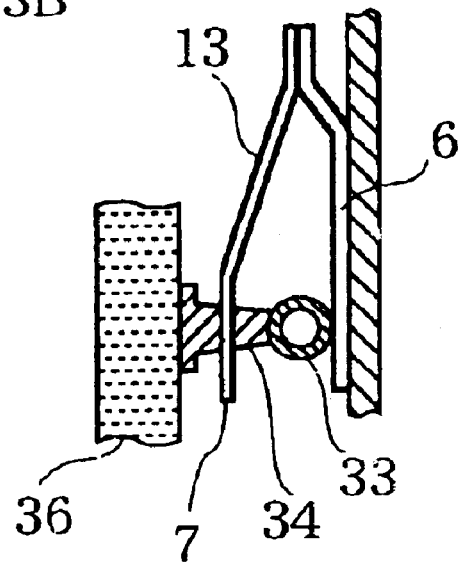
FIG. 13B is a cross sectional view thereof.
Figure 14A:
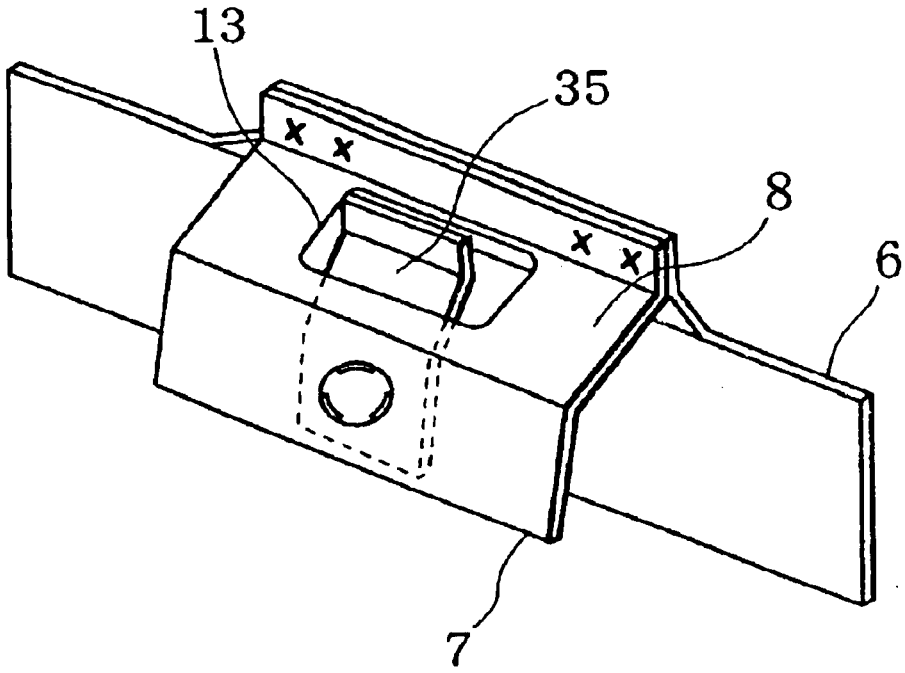
FIG. 14A is a perspective view thereof.
Figure 14B:
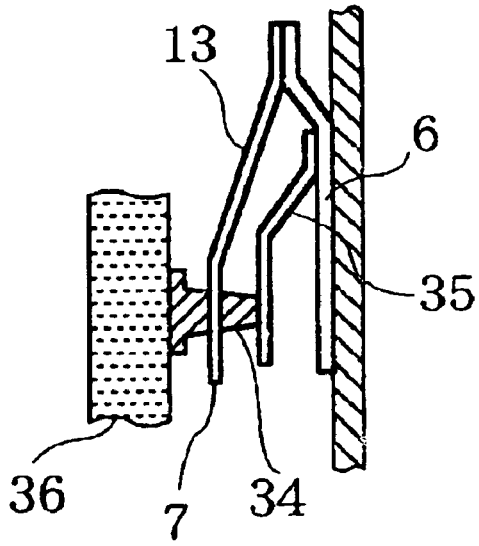
FIG. 14B is a cross sectional view thereof.

(7) It is desirable that the elastic support member comprises a vibration suppressing structure that is achieved through means such as welding a sliding member 33 having a cylindrical cross-sectional shape to the fixed portion so as to slide to a tip end of the stud pin 34 as illustrated in FIGS. 13A and B, welding a strip-like sliding member 35 to the fixed portion 6 so as to slide to the tip end of the stud pin 34 as illustrated in FIG. 14, or the like. This is due to the fact that the vibration is transmitted to the shadow mask even when the vibration of the frame is attenuated unless the vibration of frame is attenuated.

EMBODIMENT 2

Figure 15:
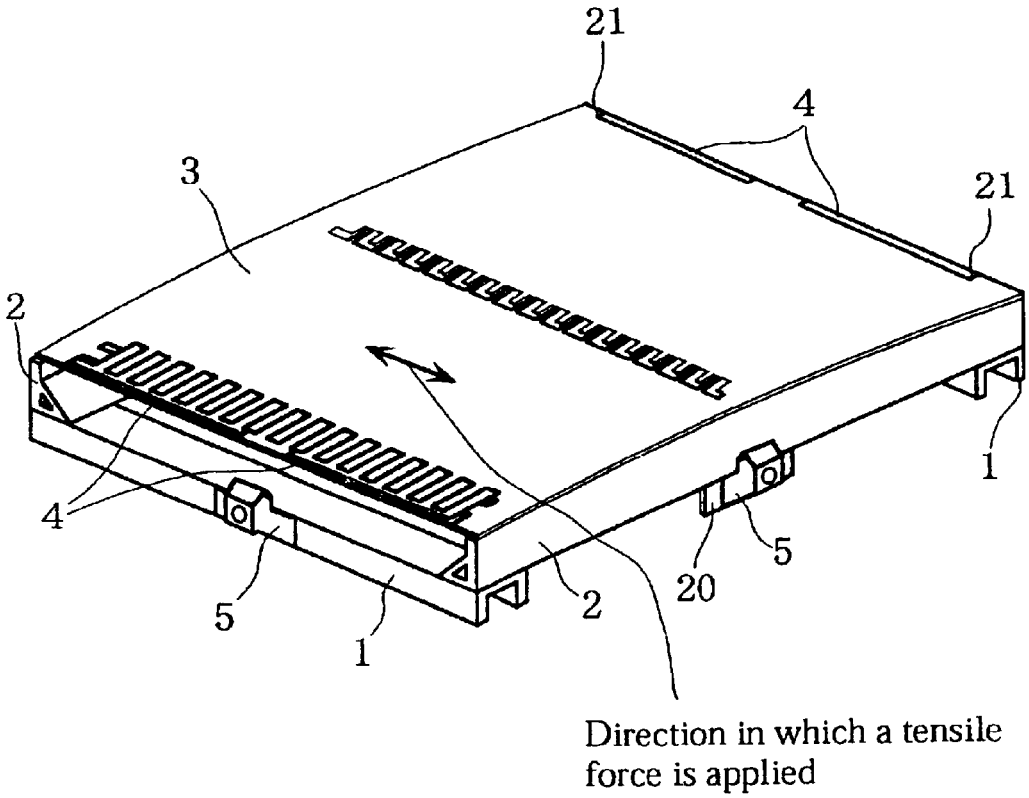
FIG. 15 is a perspective view showing an elastic support member used in Embodiment 2.

FIG. 15 is a perspective view of frame portions according to Embodiment 2 of the present invention. It should be noted that members having functions identical to those of Embodiment 1 are denoted by the same reference numerals, and therefore the explanations are omitted.

Embodiment 2 is of similar construction as that of Embodiment 1 expect that among the elastic support members 5 for attaching the frame to the panel, those disposed corresponding to the upper and lower frame portions 2 are fixed to elastic support member-holding plates 20 located substantially in the middle portions of the upper and lower frame portions 2 (the area of each elastic support member-holding plate 20 fixed to the upper and lower frame portions 2 is 15 $cm^2$), and that the shadow mask 3 has a tension distribution set to 4.0 $kgf/mm^2$ for the middle portion, 3.2 $kgf/mm^2$ for the left and right edge surface portions, and 3.5 $kgf/mm^2$ for the intermediate portions between the middle portion and the left and right edge surface portions.

Experiments

The above-described shadow mask frame was assembled into a CRT and evaluated. The results are indicated in the above Table 1. Similarly to Embodiment 1, the targets in all items were attained and the frame proved to be strong against external vibration and to be superior in terms of doming and low/high temperature characteristics as well as impact resistance. The frame may also be easily assembled since it is of on-axial SP structure, and a fraction defective during the process of attaching the frame to the panel (including photolithograph process) was remarkably decreased to be not more than 1/10.

Supplementary Remarks (1) to (7) of Embodiment 1 also applies to Embodiment 2, and therefore the explanations are omitted.

EMBODIMENT 3

Figure 16:
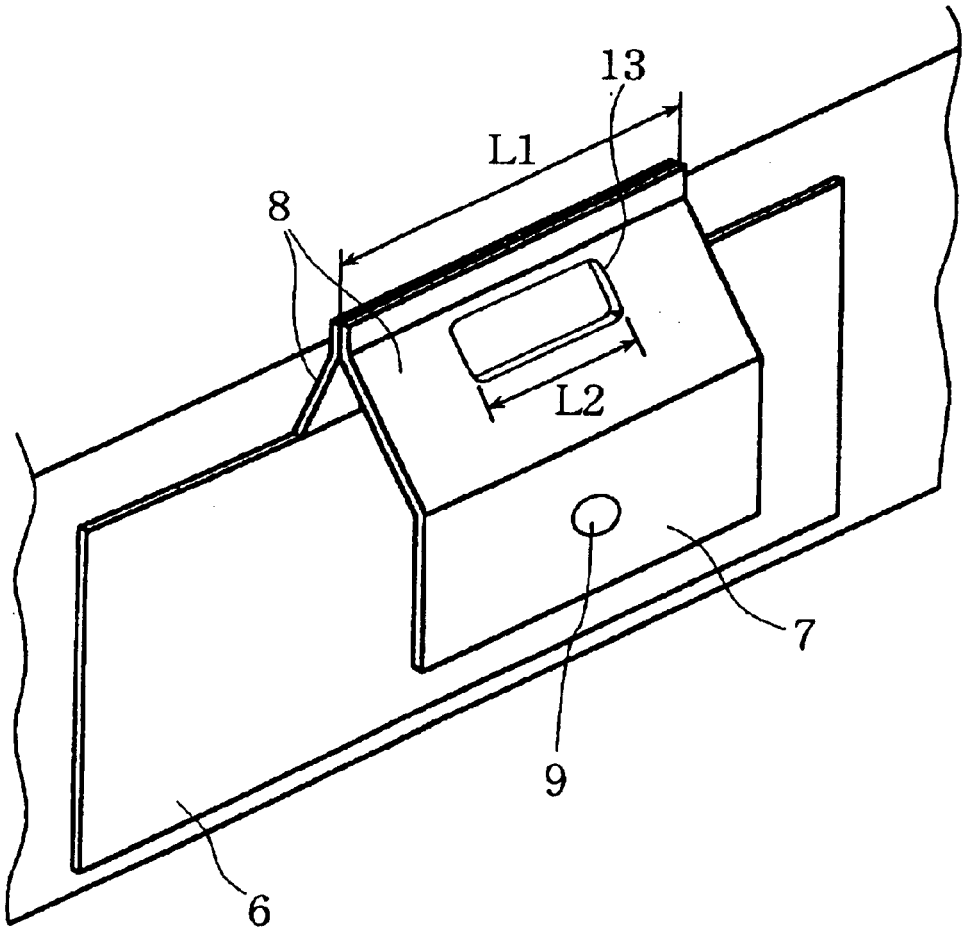
FIG. 16 is a perspective view showing an elastic support member used in Embodiment 3.

FIG. 16 is a perspective view of an elastic support member according to Embodiment 3 of the present invention. It should be noted that members having functions identical to those of Embodiment 1 are denoted by the same reference numerals, and therefore the explanations are omitted.

Embodiment 3 is of similar construction as that of Embodiment 1 expect that the elastic support members disposed to the upper and lower frame portions 2 have spring constants of 0.2 kgf/mm (L1: 50 mm, L2: 25 mm, t:0.3 mm) and that the elastic support members disposed to the left and right frame portions 1 have spring constants of 1.2 kgf/mm (L1: 50 mm, L2: 25 mm, t:0.6 mm). Note that the forces applied to the frame portions were 1.2 kgf and 3.5 kgf, respectively, when the frame was disposed in the panel by using these elastic support members.

Experiments

A frame structure as the one described above was assembled into a CRT and evaluated. The results are indicated in Table 2.

TABLE 2

| Results on Characteristics Evaluation (29-inch) | | | | | |
|---|---|---|---|---|---|
| | | Embodiment 3 | | PriorArt TCM type | |
| Item | Target | Results | Assessment | Results | Assessment |
| Vibration tapping test *1 | Color shift 2 sec or less | 0.5 sec | Good | 1.5 sec | Good |
| Loudspeaker test *2 | No color shift | No color shift | No color shift | Good | |
| Low/high temperature characteristic | 1 μm/° C. or lower | 0.9 μm/° C. | Good | 1.5 μm/° C. | Poor |
| Overall doming | 30 μm or less | 20–30 μm | Good | 40 μm | Poor |
| Drop (impact resistance) test (35 G:40 ms) | Displacement amount of frame position 20 μm or less | 15–20 μm | Good | 100 μm or greater | Poor |

Figure 17A:
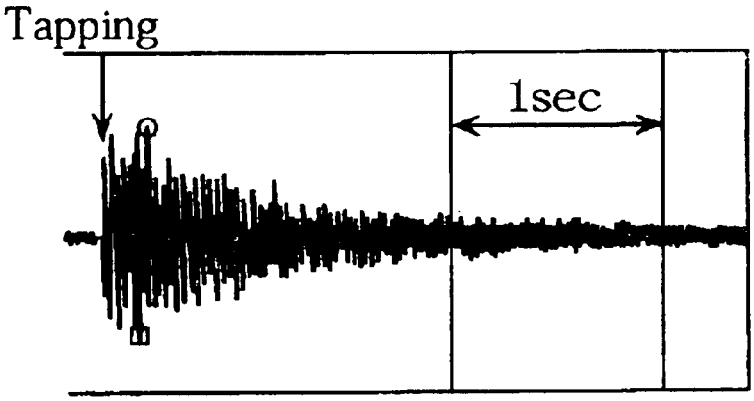
FIG. 17 is a phase diagram showing the condition of the attenuated vibration of a frame in Embodiment 3.
Figure 17B:
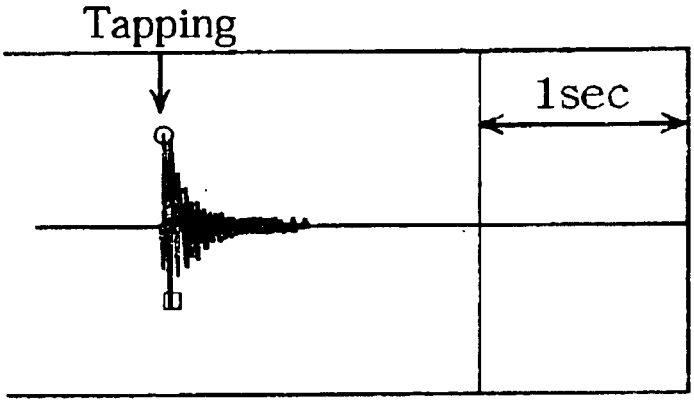

As it is evident from Table 2, the targets in all items were attained, and the frame proved to be strong against external vibration and to be superior in terms of doming and low/high temperature characteristics as well as impact resistance. Particularly in view of vibration, the vibration of the frame was suppressed in a time of 0.5 seconds or less even when such an impact as to have an acceleration of 3G was applied to the panel as illustrated in FIG. 17B. The frame may also be easily assembled since it is of on-axial SP structure, and a fraction defective during the process of attaching the frame to the panel (including photolithograph process) was remarkably decreased to be not more than 1/10.

On the other hand, the conventional TCM type frame was not sufficient in terms of doming characteristic, low/high temperature characteristic and impact resistance. Therefore, the above mechanical type is desirable.

Figure 18:
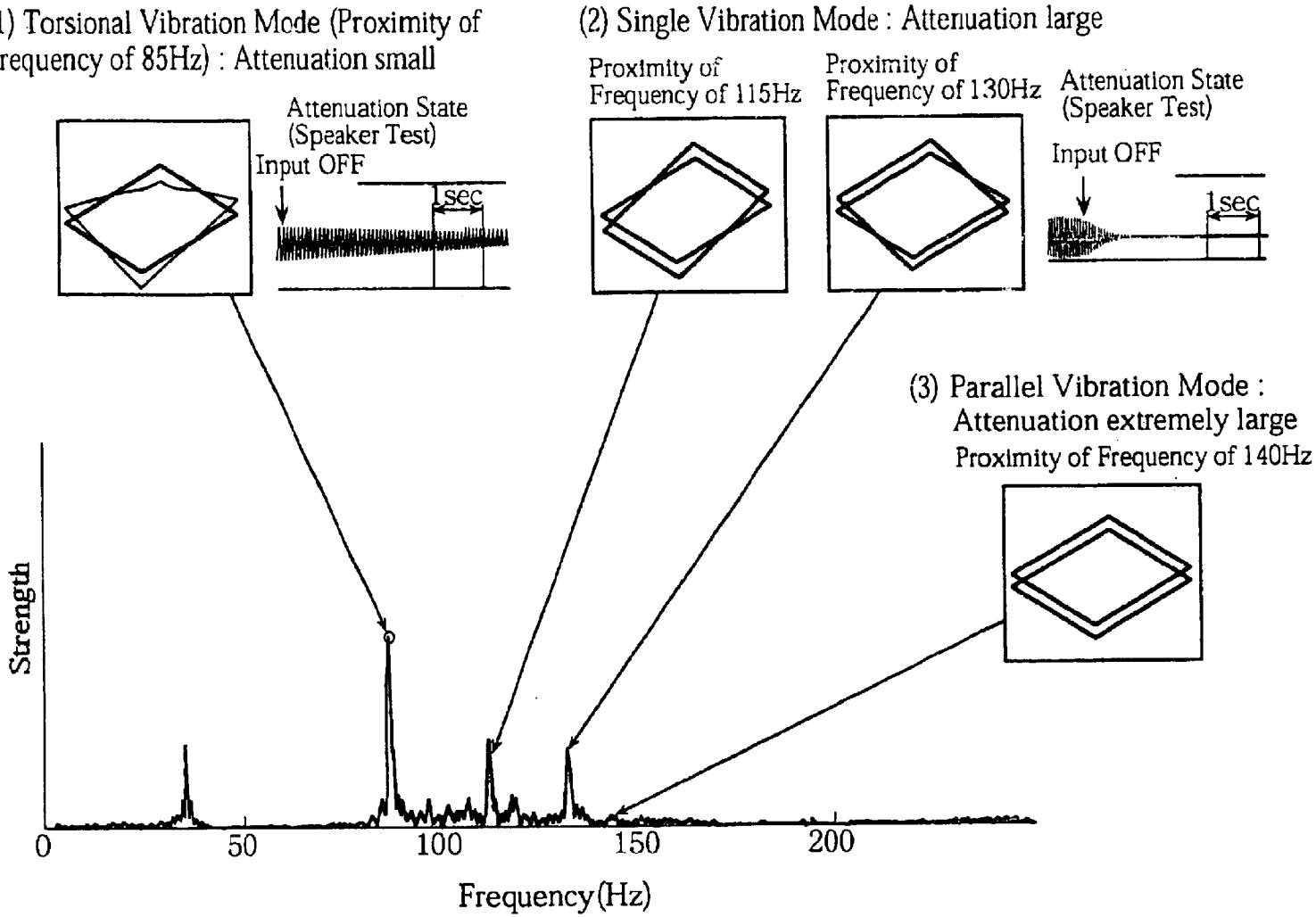
FIG. 18 is phase diagram showing the result of analysis of the vibration modes of a frame.

In this manner, the elastic support member of Embodiment 3 is effective in suppressing the vibration of the frame, and the principle will now be explained. In analyzing the vibration modes of the frame structure in which the mechanical type elastic support members are located substantially in the middle portions of the frame portions, it was found that three modes existed as illustrated in FIG. 18 (the results of analysis illustrated in FIG. 18 are those of a 29-inch panel. When the size of the panel is varied, the generated frequency of the modes changes though the mode shapes are the same).

(1) Torsional vibration mode: a mode in which the frame vibrates so as to have torsion (occurring in the proximity of 85 Hz in the case of a 29-inch frame).

(2) Single vibration mode: a mode in which the frame rotationally vibrates on the axis between the elastic support members fixed to the upper and lower frame portions or the elastic support members fixed to the left and right frame portions (occurring in the proximity of 115 Hz and 130 Hz in the case of a 29-inch frame).

(3) Parallel vibration mode: a vibration mode in which the frame performs parallel movements in a direction of the tube axis (the direction as indicated by arrow A in the drawing) (occurring in the proximity of 140 Hz in the case of a 29-inch frame).

The conditions of the attenuated vibration were measured as follows (referred to as "loudspeaker single tone test"): a loudspeaker was set onto the panel surface, a vibration having a frequency only enough to generate the respective vibration modes was applied thereto, and then the loudspeaker was turned off. It was found that the vibration could be hardly attenuated in the torsional vibration mode and the vibration continued. In the single vibration mode, the vibration could be attenuated in a time of not more than 1/10 of that required for the torsional vibration mode. In the parallel vibration mode, the vibration was attenuated as quick as measuring was nearly impossible.

Figure 19:
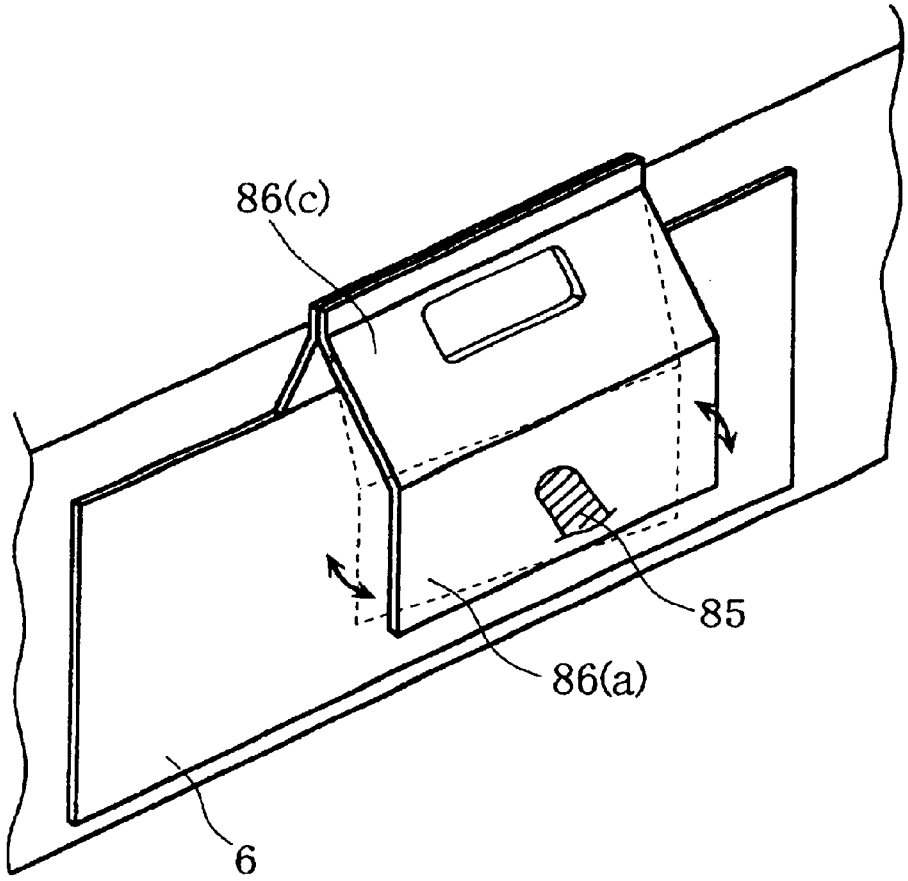
FIG. 19 is a perspective view showing the movement of an elastic support member at the time of torsional vibration mode.
Figure 20:
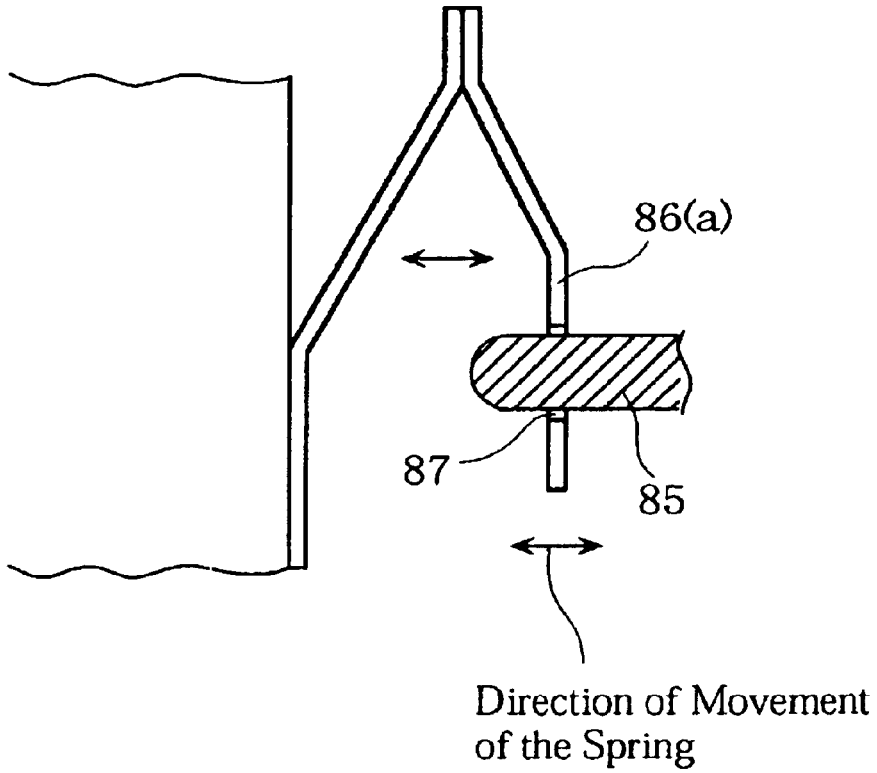
FIG. 20 is a cross sectional view showing the movement of an elastic support member at the time of single vibration mode.

The reasons for this may be attributed to the movements of the elastic support members. In the case of the torsional vibration mode, each of the elastic support members so shook about the stud pins 85 as to cause torsion to a matching portion 86(*a*) or a connecting portion 86(*c*) of the elastic support member as illustrated in FIG. 19. In such movements, because the elastic support member has no damper effect, the vibration of the frame continues without being suppressed. In the single vibration mode, the elastic support members, serving as a fulcrum, show the same movements as those of the torsional mode while the other elastic support members perform expanding and contracting movements as illustrated in FIG. 20 (expanding and contacting movements are performed in the directions indicated by the two-headed arrow). At this time, a matching opening 87 and the stud pin 85 of the elastic support member slide slightly with respect to the stud pin 85 and the matching portion 86(*a*) of the elastic support member. The friction caused by the sliding of the matching opening 87 and the stud pin 85 becomes a damper function, thereby serving to suppress the vibration of the frame. In the parallel vibration mode, all the elastic support members perform the expanding and contracting movements, thereby creating quite a large damper function so that the vibration of the frame is instantly suppressed.

All the elastic support members disposed to the left and right frame portions and the upper and lower frame portions are identical (in shape, in spring constant, and the like) in most cases. If this is the case, the vibration of the frame is mainly of the torsional mode and the single vibration mode or the parallel vibration mode hardly occurs. Thus, the vibration of the frame continues without being suppressed. It was found that the two vibration modes of the single vibration mode and the parallel vibration mode could be brought about by employing elastic support members having different spring constants.

Table 3 illustrates the results of the intensity ratios of the torsional mode and the single vibration mode were obtained in the case that the spring constants of the elastic support members disposed to the upper and lower frame portions were fixed to be 0.2 kgf/mm, and the spring constants of the elastic support members disposed to the left and right frame portions were varied in the range of 0.2 kgf/mm to 1.9 kgf/mm.

TABLE 3

| Spring constant of the springs disposed to the upper and lower frame portions: 0.2 kgf/mm | | |
|---|---|---|
| Spring constant of the springs disposed to the | Vibration intensity (relative ratio) | |
| left and right frame portions | Torsional mode | Single vibration mode |
| k: 0.2 kgf/mm | 5 | 0 |
| k: 1.2 kgf/mm | 3 | 1.7 |
| k: 1.5 kgf/mm | 1 | 0.5 |
| k: 1.9 kgf/mm | 0.6 | 0.7 |

The intensities as illustrated in Table 3 are the relative values in a case where the vibration intensity of a measuring system when external vibration is applied is set to be 1. It can be understood from these results that the single vibration mode predominates by varying the spring constants of the elastic support members for the left and right frame portions and for the upper and lower frame portions.

By varying the spring constants of the elastic support members in the above manner, a part of the torsional vibration mode can be switched to the single vibration mode so that the vibration of the frame can be suppressed. An effective means to increase the intensity of the single vibration mode is that the opposing elastic support members disposed to the upper and lower frame portions have the same spring constant and the opposing elastic support members disposed to the left and right frame portions have the same spring constant.

The spring constant of each elastic support member can be relatively easily varied without varying the size of the elastic support member by forming an opening in the connecting portion of the elastic support member and adjusting the size of the opening.

Supplementary Remarks (1) to (7) of Embodiment 1 also applies to Embodiment 3, and therefore the explanations are omitted.

(8) In Embodiment 3, the elastic support members are directly disposed to the frame. However, the invention is not limited thereto. As shown in Embodiment 2, the elastic support member may be disposed to the frame with the elastic support member-holding plate interposed therebetween.

(9) According to Embodiment 3 of the present invention, each of the elastic support members is located substantially in the middle of a frame portion. While the invention is not limited thereto, it should be noted that it is preferable that the elastic support member is located substantially in the middle of the frame portion in order to suppress the vibration of the mask, more effectively.

(10) In order to increase the intensity of the single vibration mode, it is desired that of the elastic support members, opposing elastic support member have the same spring constant.

(11) It is preferable that the mask is stretched across the frame in a state where a tensile force (tension) is applied thereto. In this case, it is more preferable that the tension distribution of the mask be such that the tension in the middle is larger than the tension at the edge portions. This is because in the shadow mask in which a damper for attenuating the vibration is provided, the vibration of the entire mask can be certainly attenuated by providing a tension distribution in which the tension is largest in the middle portion while it becomes gradually lower toward the edge portions.

(12) The third aspect of the present invention can be applied to a mask in which a flat-faced mask provided with a plurality of electron beam-passing apertures are stretched in the vertical/horizontal direction, and also a mask in which a plurality of thin lines called aperture grills are stretched in the vertical direction. Incidentally, furthermore, the shadow mask is not limited to the flat-faced mask, and may be a mask being stretched so as to have a cylindrical surface.

EMBODIMENT 4

Figure 21:
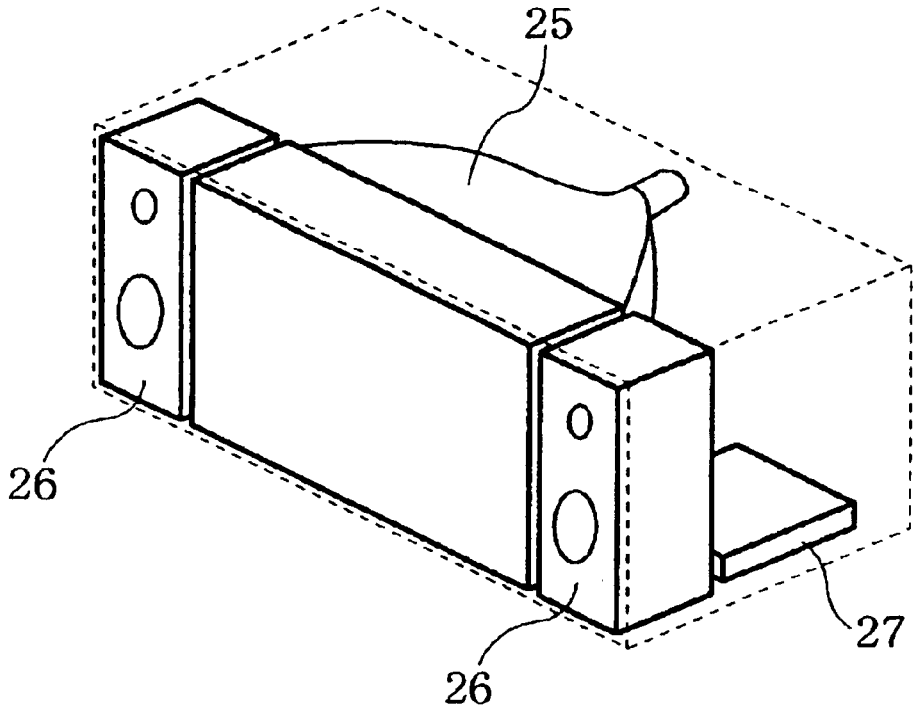
FIG. 21 is a perspective view showing Embodiment 4.

Embodiment 4 of the present invention is a TV set to which the color picture tube according to Embodiments 1 to 3 is applied. FIG. 21 is a perspective view showing an outline of Embodiment 4. Reference numeral 25 denotes a color picture tube of the present invention. Reference numeral 26 denotes a loudspeaker. Reference numeral 27 denotes a circuit such as an electron beam controlling and tuner. With such structure, a flat TV set in which color shift caused by external vibration is small and reliability against unexpected accidents at the time of transportation is high is realized.

Incidentally, the structure of the present invention is not limited to the TV set, and may be applied to a general image display apparatuses such as a monitor.

INDUSTRIAL APPLICABILITY

As has been described above, the present invention is advantageous in that it provides a color picture tube that has a strong resistance to external vibration, good doming and low/high temperature characteristics, and good impact resistance and is easy to be assembled. The invention also provides a flat TV set employing the color picture tube.

What is claimed is:

1. A cathode ray tube, comprising at least a panel having a phosphor screen thereon, a shadow mask having a plurality of electron beam-passing portions, and a frame across which the shadow mask is stretched so that a tensile force is applied thereto, the frame being securely attached to the panel by an elastic support member and the phosphor screen is opposed to the shadow mask, wherein:

the elastic support member is located substantially in the middle portion of the frame;

the spring constant of the elastic support member is in the range of 0.1 kgf/mm to 2.5 kgf/mm when the frame is located in the panel with the elastic support member; and the shadow mask is configured such that the tension in a middle portion of the shadow mask is larger than the tension at edge portions of the shadow mask.

2. A cathode ray tube, comprising at least a panel having a phosphor screen thereon and a panel side wall, a shadow mask having a plurality of electron beam-passing portions, and a frame across which the shadow mask is stretched so that a tensile force is applied thereto, the frame being securely attached to the panel by an elastic support member and the phosphor screen is opposed to the shadow mask, wherein:

the elastic support member is located substantially in a middle portion of the frame;

the elastic support member comprises a fixed portion fixed to the frame, a matching portion matched to a stud pin located on the inside of the panel side wall, and a connecting portion connecting the matching portion and the fixed portion;

the spring constant of the elastic support member is in the range of 0.1 kgf/mm to 2.5 kgf/mm; and the shadow mask is configured such that the tension in a middle portion of the shadow mask is larger than the tension at the edge portions of the shadow mask.

3. The cathode ray tube according to claim 2, wherein the connecting portion has an approximately V-shaped configuration.

4. The cathode ray tube according to claim 2, wherein the fixed portion of the elastic support member has an area of at least 5 $cm^2$.

5. The cathode ray tube according to claim 2, wherein the ratio of the area of the fixed portion of the elastic support member to the area of the frame portion to which the elastic support member is greater than 1/25.

6. The cathode ray tube according to claim 2, wherein the elastic support member includes a vibration suppressing structure.

7. The cathode ray tube according to claim 2, wherein the connecting portion of the elastic support member has an opening having a predetermined size that determines the spring constant of the elastic support member.

8. The cathode ray tube according to claim 2, wherein the shadow mask comprises a damper for attenuating vibration.

9. The cathode ray tube according to claim 8, wherein the damper is freely movable relative to the shadow mask.

10. The cathode ray tube according to claim 9, wherein the damper is located in an opening in the shadow mask.

11. The cathode ray tube according to claim 10, wherein the damper is a wire-like member.

12. The cathode ray tube according to claim 10, wherein the damper is a ring-like member.

13. The cathode ray tube according to claim 2, wherein the shadow mask comprises a Fe—Ni alloy.

14. The cathode ray tube according to claim 2, wherein the elastic support member is fixed to an elastic support member-holding plate located substantially in the middle of the frame.

15. The cathode ray tube according to claim 14, wherein the elastic support member includes a vibration suppressing structure.

16. The cathode ray tube according to claim 14, wherein the shadow mask comprises a damper for attenuating vibration.

17. The cathode ray tube according to claim 16, wherein the damper is freely movable relative to the shadow mask.

18. The cathode ray tube according to claim 17, wherein the damper is located in an opening in the shadow mask.

19. The cathode ray tube according to claim 18, wherein the damper is a wire-like member.

20. The cathode ray tube according to claim 18, wherein the damper is a ring-like member.

21. The cathode ray tube according to claim 14, wherein the shadow mask comprises a Fe—Ni alloy.

22. An image display apparatus, comprising:

a cathode ray tube, an electron beam controlling circuit and a cabinet, wherein the cathode ray; tube comprises:

at least a panel having a phosphor screen thereon, a shadow mask having a plurality of electron beam-passing portions, and a frame across which the shadow mask is stretched so that a tensile force is applied thereto, the frame being securely attached to the panel by an elastic support member and the phosphor screen is opposed to the shadow mask, wherein:

the elastic support member is located substantially in the middle portion of the frame;

the spring constant of the elastic support member is in the range of 0.1 kgf/mm to 2.5 kgf/mm when the frame is located in the panel with the elastic support member; and the shadow mask is configured such that the tension in a middle portion of the shadow mask is larger than the tension at edge portions of the shadow mask.

23. The image display apparatus according to claim 22, further comprising a loudspeaker connected to the display apparatus.

* * * * *